US005204234A

United States Patent [19]

Asami

[11] Patent Number: 5,204,234

[45] Date of Patent: Apr. 20, 1993

[54] SILVER HALIDE PHOTOGRAPHIC MATERIAL WHICH CONTAINS AN IRON DOPANT AND SUBSTANTIALLY NO SILVER IODIDE

[75] Inventor: Masahiro Asami, Minami-ashigara, Japan

[73] Assignee: Fuji Photo Film Co., Ltd., Kanagawa, Japan

[21] Appl. No.: 595,290

[22] Filed: Oct. 10, 1990

[30] Foreign Application Priority Data

Oct. 18, 1989 [JP] Japan ..... 1-271081

[51] Int. Cl.[5] ..... G03C 1/08; G03C 1/005

[52] U.S. Cl. ..... 430/567; 430/604

[58] Field of Search ..... 430/604, 567

[56] References Cited

U.S. PATENT DOCUMENTS 5,057,402 10/1991 Shiba et al. ..... 430/604

FOREIGN PATENT DOCUMENTS 325235 7/1989 European Pat. Off. ..... 430/567

2206700 1/1989 United Kingdom ..... 430/567

*Primary Examiner*—Charles L. Bowers, Jr.

*Assistant Examiner*—Mark F. Huff

*Attorney, Agent, or Firm*—Burns, Doane, Swecker & Mathis

[57] ABSTRACT

There is disclosed a silver halide photographic material having at least one photosensitive emulsion layer containing silver halide emulsion of surface latent image type. The silver halide emulsion comprises high-silver-chloride emulsion grains that have a localized phase containing iron ions in a limited amount. According to the disclosure a silver halide photographic material can be attained that is excellent in rapid processability and high in sensitivity and contrast.

11 Claims, No Drawings

SILVER HALIDE PHOTOGRAPHIC MATERIAL WHICH CONTAINS AN IRON DOPANT AND SUBSTANTIALLY NO SILVER IODIDE

FIELD OF THE INVENTION

The present invention relates to photographic materials using silver halide photographic emulsions of a surface latent image type, and more particularly to a silver halide photographic material that is excellent in rapid processability and high in sensitivity and contrast, and wherein there is reduced sensitivity fluctuation due to a change of temperature or illuminance at the time of exposure and reduced desensitization due to pressure.

BACKGROUND OF THE INVENTION

At present, photographic materials using silver halide photographic emulsions are used for various purposes in the market, and the market for such materials has been increasing in recent years.

In these circumstances, shortening the development processing time of photographic materials used where there is strong demand to finish a large amount of prints in a short delivery time, particularly as in the case of photographic materials for color prints leads directly to improved production efficiency of the prints so that many studies on increasing developing speed have been made.

It is well known that developing speed is greatly improved when the content of silver chloride in the silver halide emulsion used in the photographic materials is increased. However, it has been known that the use of an emulsion high in silver chloride content is accompanied by such defects as high fogging, that high sensitivity is difficult to obtain, that the so-called reciprocity law failure, which results in a change of sensitivity due to a change in exposure illuminance, is large, and that the sensitivity also changes greatly due to a change in temperature at the time of exposure.

Various techniques have been disclosed to overcome the above defects involved in silver halide emulsions high in silver chloride content (hereinafter referred to as high-silver chloride emulsion).

For example, JP-A ("JP-A" means unexamined published Japanese patent application) Nos. 95736/1983, 108533/1983, 222844/1985, and 222845/1985 disclose that in order to render high-silver-chloride emulsions highly sensitive, it is effective to make the silver halide grains have various structures, for example a layer high in silver bromide content. However, as a result of study by the inventors it has been found that, according to these techniques, although the sensitivity does indeed increase, when the emulsion grains undergo pressure, desensitization is liable to take place, which is a major defect in practice. Further, with these techniques it has also been found that it is difficult to reduce sufficiently the reciprocity law failure involved with a high-silver chloride emulsion.

For example, JP-A No. 139323/1976 or 171947/1984 or British Patent Specification 2109576A describes that when a compound of a metal of Group VIII is added, high sensitivity can be obtained and the reciprocity law failure can be reduced. JP-B ("JP-B" means examined Japanese patent publication) No. 33781/1974, JP-A No. 23618/1975, 18310/1977, 15952/1983, 214028/1984, or 67845/1986, German Patent No. 2,226,877 or 2,708,466, or U.S. Pat. No. 3,703,584 describes that high contrast and a reduction in reciprocity law failure can be attained by the inclusion of a rhodium compound or an iridium compound. However, when a rhodium compound is used, although an emulsion high in contrast can be obtained, extreme desensitization occurs, which is not preferable in practice. And, when an iridium compound is used, so-called latent-image sensitization, wherein the development density often increases with the passage of time from the exposure of the photographic material to processing, is observed conspicuously, which is also not preferable in practice.

Further, U.S. Pat. No. 4,269,927 describes that when cadmium, copper, zinc, or a mixture of these is contained within surface-sensitive high-silver chloride emulsion grains having a silver chloride content of 80 mol % or over, high sensitivity can be obtained. However, although this technique has a small effect in increasing sensitivity and in reducing reciprocity law failure, the lessening of sensitivity fluctuation due to a change in temperature at the time of exposure was not sufficient.

JP-B No. 35373/1973 describes that a high-contrast black and white photographic paper can be obtained inexpensively by the inclusion of a water-soluble iron compound into a silver chloride emulsion produced by a single-jet process. However, with this technique it is difficult to obtain an appropriate effect because if the amount of the iron compound to be added is increased to attain high sensitivity, desensitization is liable to occur when the emulsion undergoes pressure.

Further, JP-A No. 183647/1989 describes an improved technique wherein when silver bromide localized phases are allowed to be present within high-silver chloride emulsion grains containing iron ions or on the surface thereof, high sensitivity can be obtained and the fluctuation of sensitivity due to a change in temperature at the time of exposure can be made small. However, this technique still has an unsolved problem in that the introduction of silver bromide localized phases means that desensitization is apt to occur when the emulsion grains undergo pressure.

BRIEF SUMMARY OF THE INVENTION

Therefore the first object of a present invention is to provide a silver halide photographic material excellent in rapid processability and high in sensitivity and contrast.

A second object of the present invention is to provide a silver halide photographic material wherein there is little fluctuation of sensitivity due to a change of exposure illuminance or exposure temperature.

A third object of the present invention is to provide a silver halide photographic material wherein desensitization hardly takes place when the emulsion grains undergo pressure.

Other and further objects, features, and advantages of the invention will appear more fully from the following description.

DETAILED DESCRIPTION OF THE INVENTION

The above objects of the present invention have been achieved effectively by providing a silver halide photographic material having on its base at least one photosensitive emulsion layer containing silver halide emulsion of a surface latent image-type, characterized in that said emulsion layer contains silver halide grains of silver chloride or silver chlorobromide made up of 90 mol % or more of silver chloride substantially free from silver iodide, said silver halide grains containing iron ions in an amount of $10^{-7}$ to $10^{-3}$ mol per mol of the silver halide, and a localized phase, wherein the concentration of said iron ions is ten times or more that of the other part which is present in the surface layer of the silver halide grains and amounts to 50% or less of the grain volume.

The present invention will now be described in detail.

The silver halide emulsion of the present invention is composed of silver chloride or silver chlorobromide made up of 90 mol % or more of silver chloride and is substantially free from silver iodide. The expression and is substantially free from silver iodide" means that the content of silver iodide is 0.5 mol % or less, preferably 0.1 mol % or less, and more preferably nil. Although it is required that the silver chloride content is 90 mol % or more, preferably the silver chloride content is 95 mol % or more, and particularly preferably 98 mol % or more. Further, an emulsion made of silver chloride but containing iron ions and polyvalent metals below described as dopants is also preferable.

If the silver halide emulsion of the present invention contains silver bromide, it is preferable to allow the silver bromide to be present in the form of silver bromide localized phases having a silver bromide content of 70 mol % or less, more preferably 10 to 70 mol %, most preferably 15 to 60 mol %, within the grains or on the surfaces of the grains.

In the present invention, in order to incorporate iron ions into silver halide emulsion grains, it is easy to allow a water-soluble iron compound to be present in the step of forming the emulsion grains. The iron compound is a compound containing a bivalent or trivalent iron ion, and preferably the iron compound is soluble in water in the range of amount used in the present invention. Particularly preferably the iron compound is an iron complex salt that can easily be incorporated in the silver halide grains. Specific examples of the compound are listed below, but the effect of the present invention is not limited by use of them: ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ferrous ammonium nitrate, basic ferric acetate, ferric albuminate, ferric ammonium acetate, ferric bromide, ferric chloride, ferric chromate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidium ferric sulfate, ammonium ferric citrate, potassium hexacyanoferrate(II), potassium pentacyanoamineferrate(II), sodium iron(III) ethylenedinitrilotetraacetic acetate, potassium hexacyanoferrate(III), iron(III) tris(pipyridyl) chloride, and potassium pentacyanonitrosylferrate(III).

Of these compounds, in particular, a hexacyanoferrate(II), a hexacyanoferrate (III), ferrous thiocyanate, and ferric thiocyanate exhibit a remarkable effect.

The above iron compound is incorporated into the grains by allowing it to be present in a solution of a dispersion medium (gelatin or a polymer having protective colloid properties), an aqueous solution of the halide, an aqueous solution of the silver salt, or other aqueous solution when the silver halide grains are formed.

In the present invention, the amount of the iron compound to be used is $10^{-7}$ to $10^{-3}$ mol, more preferably $10^{-6}$ to $5\times10^{-4}$ mol, per mol of the silver halide.

It is necessary for the iron compound used in the present invention to be contained in a concentrated manner in the surface layer that amounts to 50% or less of the grain volume of a silver halide grain. The expression "surface layer that comprises 50% or less of the grain volume" refers to the surface part corresponding to a volume of 50% or less of the volume of a grain. The volume of the surface layer is preferably 40% or less, and more preferably 20% or less. By making the volume of the surface layer as small (thin) as possible, the effect of the present invention can be exhibited more remarkably.

In order to incorporate iron ions in the surface layer in a concentrated manner, after cores of silver halide grains, except the surface layer, are formed, the iron compound is supplied together with the supply of an aqueous silver salt solution and an aqueous halide solution for forming the surface layer.

If the volume ratio of the surface layer where iron ions are contained is too large, desensitization is liable to take place when pressure is exerted on the emulsion grains, and high sensitivity is difficult to attain.

In order to cause the effect of the present invention to be exhibited adequately, preferably the layer in which iron ions are contained is limited to the surface layer that amounts to 50% or less of the grain volume, though a portion of the iron ions may be contained in core parts of the grains. However, in the latter case, it is required that the concentration of iron ions to be contained in the surface layer of the grains must be ten times or more, preferably 50 times or more, more preferably 100 times or more, that of the core parts of the grains. In other words, 90% or more of iron ions contained in a grain exist in the surface layer, the volume of which corresponds to 50%, preferably 40%, more preferably 20%, of the total volume of the grain. If the concentration of iron ions in the core parts of the grains exceeds the mentioned concentration, desensitization is liable to take place when the emulsion grains undergo pressure, and the effect of the present invention is difficult to attain.

In the present invention, preferably the amount of iron ions to be contained in the silver halide grains is in the range mentioned above. If the amount is less than the amount specified in the present invention, the effect is difficult to attain, while if the amount is too large, desensitization is liable to take place under the influence of pressure.

In the present invention, polyvalent metal dopants other than iron ions may also be additionally used, to be contained in the silver halide grains. As examples thereof, ions of Group VIII metals, such as cobalt, nickel, ruthenium, rhodium, palladium, osmium, iridium, or platinum can be mentioned. Besides these, ions of such metals as copper, gold, zinc, cadmium or lead may also be additionally added.

The average grain size of the silver halide grains contained in the silver halide emulsion used in the present invention (the average grain size being the average number obtained when assuming the diameters of circles equivalent to the projected areas of the grains to be the grain sizes) is preferably 0.1 to 2 μm.

Preferably the grain size distribution is one having a deviation coefficient (which is obtained by dividing the standard deviation of the grain size distribution by the average grain size) of 20% or less, and desirably 15% or less, that is, a so-called monodisperse distribution. In this case, in order to obtain wide latitude, also preferably the above-mentioned monodisperse emulsions are blended and used in the same layer, or are applied as layers one upon the other.

The shape of the silver halide grains contained in the photographic emulsion may be of a regular crystal form, such as cubic, tetradecahedral, or octahedral, or of an irregular crystal form, such as spherical or tabular, or mixtures of these. The silver halide grains may be made up of a mixture of silver halide grains having various crystal forms. In the present invention, grains are good wherein 50% or more, preferably 70% or more, and more preferably 90% or more, have the above regular crystal form.

In addition, emulsions can also be preferably used wherein tabular grains having an average aspect ratio (in terms of circle diameter/thickness) of 5 or over, preferably 8 or over, and amount to more than 50% of all the grains in terms of projected area.

The silver chlorobromide emulsion used in the present invention can be prepared by the methods described, for example, by P. Glafkides in *Chimie et Phisique Photocraphique* (published by Paul Montel, 1967), by G. F. Duffin in *Photographic Emulsion Chemistry* (published by Focal Press, 1966), and by V. L. Zelikman et al. in *Making and Coating Photographic Emulsion* (Focal Press, 1964). That is, any method of the acid method, the neutral method, the ammonia method, etc., can be used, and as the type wherein a soluble silver salt and a soluble silver halide are reacted, any method of the single jet method, the double-jet method, the combined method of these, etc., can be used. Also the method wherein grains are formed in an atmosphere containing excess silver ions, that is, the so-called reverse precipitation method, can also be used. As one type of the reverse precipitation method, a method wherein the pAg in the liquid phase where the silver halide is formed is kept constant, that is, the so-called controlled double jet method, can also be used. Using the controlled double jet method, a silver halide emulsion wherein the crystal form is regular and the grain size is nearly uniform can be obtained.

Into the silver halide emulsion used in the present invention can be introduced various polyvalent ion dopants in the process of the formation or physical ripening of the emulsion grains. Examples of a compound to be used include a salt of cadmium, zinc, lead, copper, thulium, etc., and a salt or complex salt of platinum, iridium, osmium, palladium, rhodium, ruthenium, and iron which are elements of Group VIII. In particular, the above elements of Group VIII can be preferably used. The range to meet the purpose, preference being given to $10^{-9}$ to $10^{-2}$ mol per the silver halide.

Generally, the silver halide emulsion used in the present invention is chemically and spectrally sensitized.

As the chemical sensitization method, sulfur sensitization, typically by the addition of an unstable sulfur compound, noble metal sensitization, typically gold sensitization, or reduction sensitization can be used alone or in combination. As compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivity in desired wavelength regions. In the present invention, the spectral sensitization is preferably carried out by adding dyes that absorb light in the wavelength ranges corresponding to the aimed for spectral sensitivities, that is, by adding spectrally sensitizing dyes. As the spectrally sensitizing dyes used herein, for example, those described by F. M. Harmer in *Heterocyclic compounds—Cyanine dyes and related compounds* (published by John Wiley & Sons [New York, London], 1964) can be mentioned. As specific examples of the compounds and the spectral sensitization method, those described in the above JP-A No. 215272/1987, page 22 (right upper column) to page 38, are preferably used.

In the silver halide emulsion used in the present invention, various compounds or their precursors can be added for the purpose of stabilizing the photographic performance or preventing fogging that will take place during the process of the production of the photographic material, or storage, or photographic processing of the photographic material. As specific examples of these compounds, those described in the above-mentioned JP-A No. 215272/1987, pages 39 to 72 are preferably used.

As the emulsion used in the present invention, use is made of the so-called surface-sensitive emulsion, wherein a latent image is formed mainly on the grain surface.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-1), (C-II), (M-I), (M-II), and (Y):

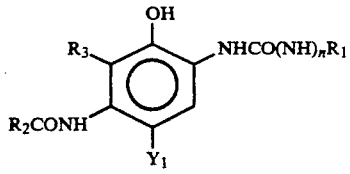

Formula (C-I)

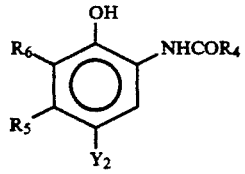

Formula (C-II)

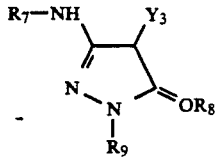

Formula (M-I)

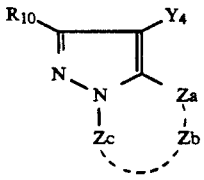

Formula (M-II)

-continued

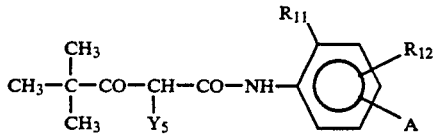

Formula (Y)

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za—Zb bond and the Zb—Zc bond is a double bond, and the other is a single bond. If the Zb—Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom or an alkoxy group. A represents —$NHCOR_{13}$, —$NHSO_2$—$R_3$, —$SO_2NHR_{13}$, —$COOR_{13}$, or $$-SO_2\underset{\underset{R_{14}}{|}}{N}-R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.

(C-1)
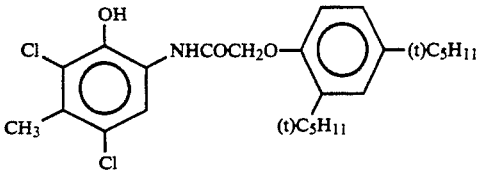
(C-2)
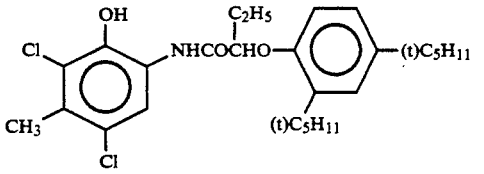
(C-3)
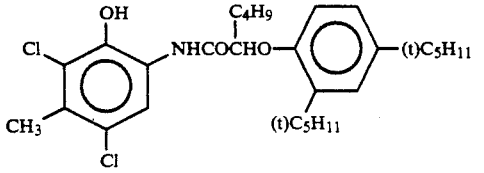
(C-4)
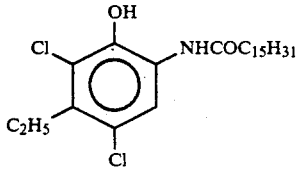
(C-5)
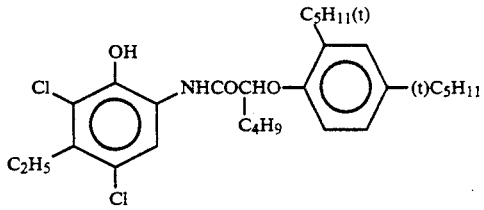
(C-6)
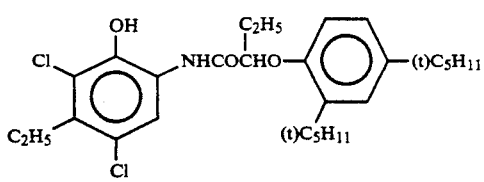
(C-7)
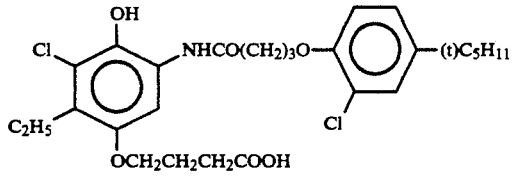
(C-8)
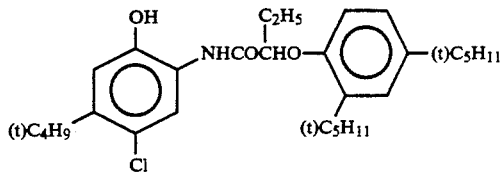

-continued
(C-9)
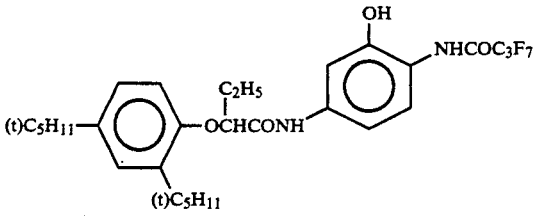
(C-10)
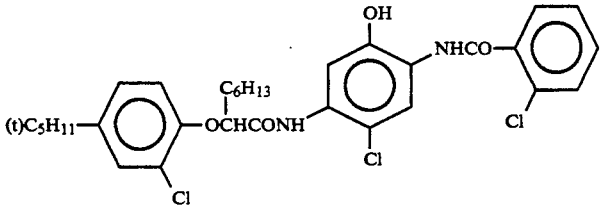
(C-11)
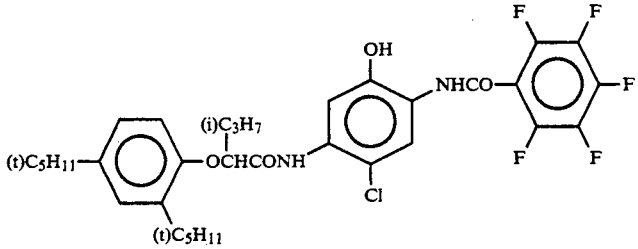
(C-12)
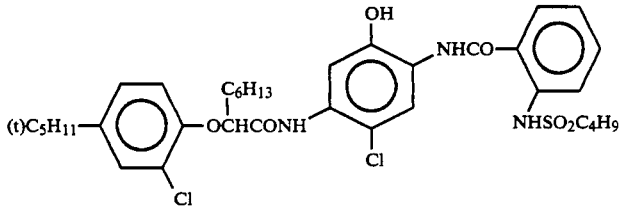
(C-13)
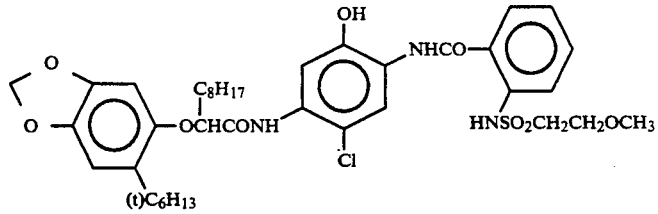
(C-14)
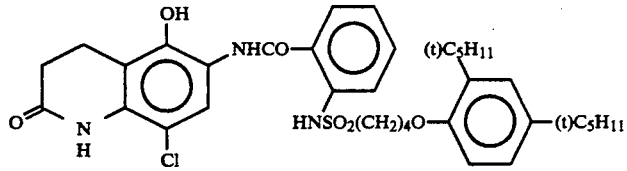
(C-15)
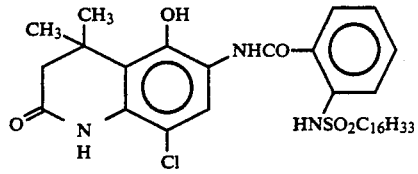

-continued
(C-16)
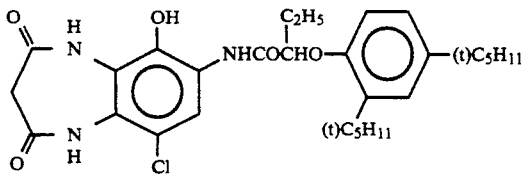
(C-17)
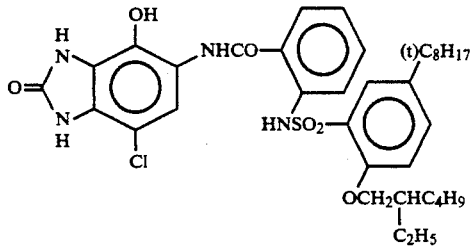
(C-18)
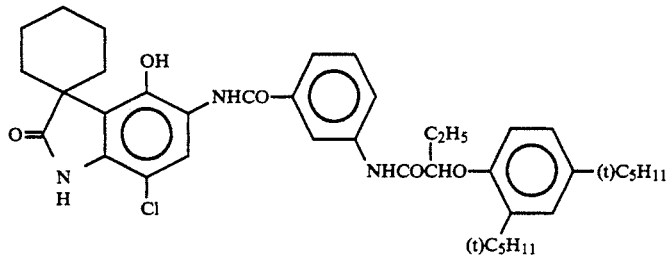
(C-19)
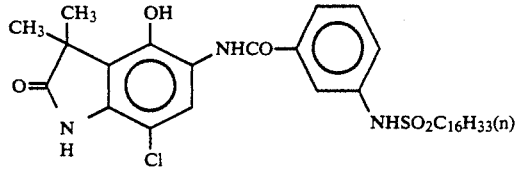
(C-20)
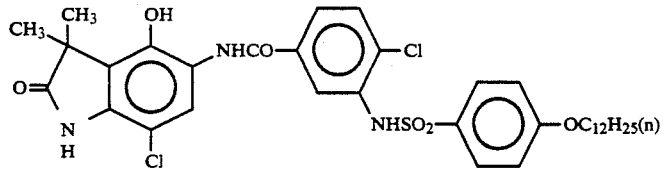
(C-21)
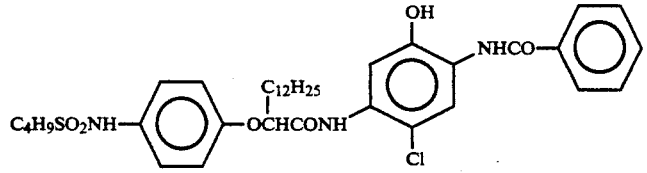
(C-22)
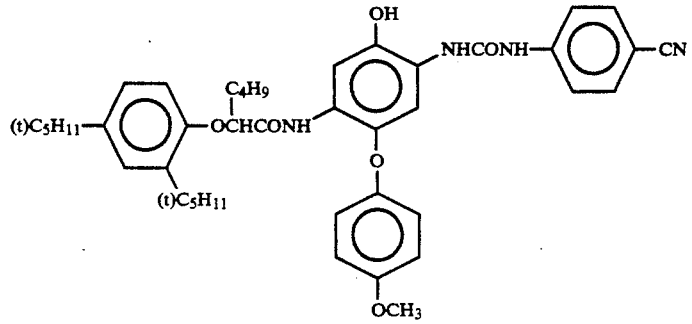

-continued
(M-1)
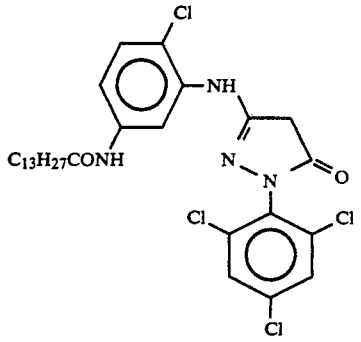
(M-2)
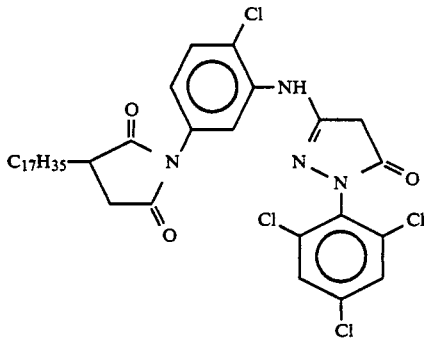
(M-3)
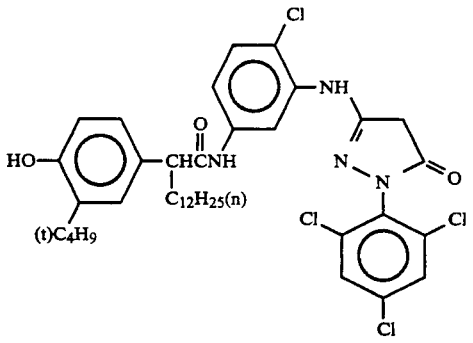
(M-4)
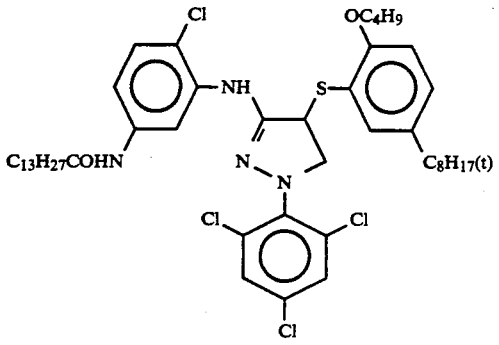

-continued
(M-5)
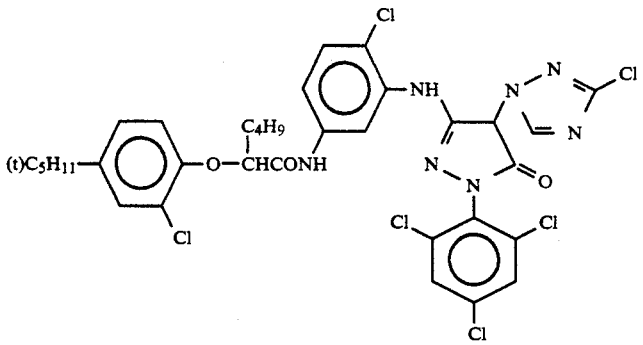
(M-6)
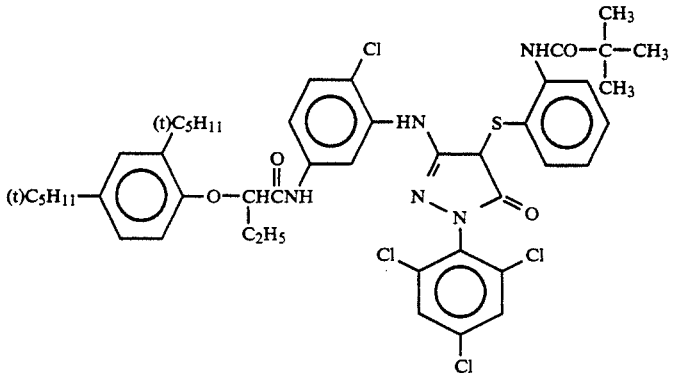
(M-7)
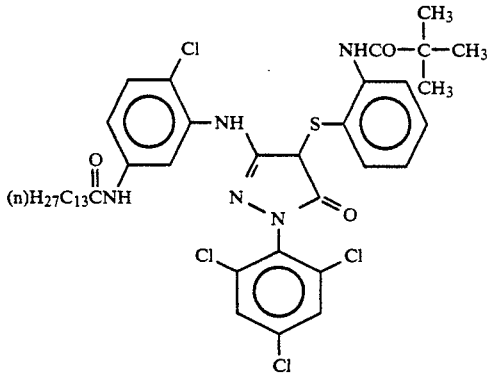
(M-8)
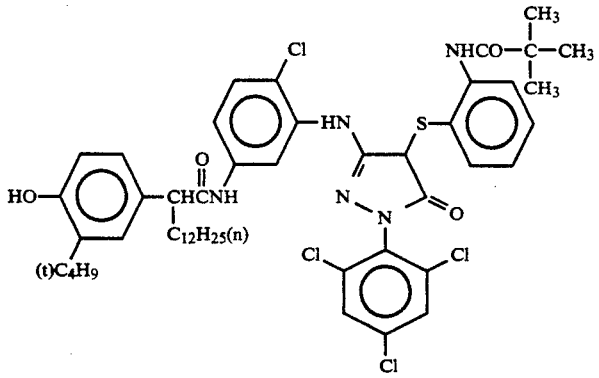

| Compound | $R_{10}$ | $R_{15}$ | $Y_4$ |
|---|---|---|---|
| M-9 | $CH_3$— | 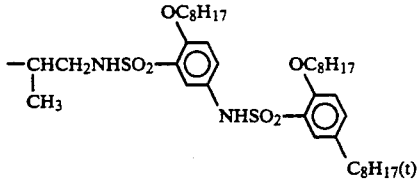 | Cl |
| M-10 | The same as the above | 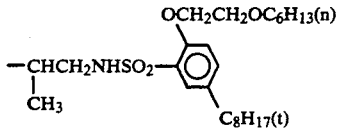 | The same as the above |
| M-11 | $(CH_3)_3C$— | 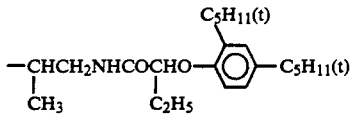 | 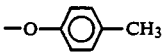 |
| M-12 | 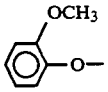 | 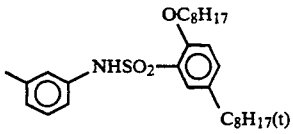 | 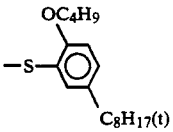 |
| M-13 | $CH_3$— | 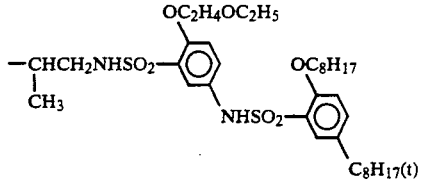 | Cl |
| M-14 | The same as the above | 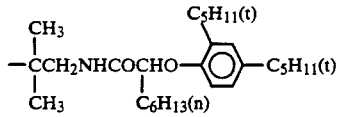 | The same as the above |
| M-15 | The same as the above | 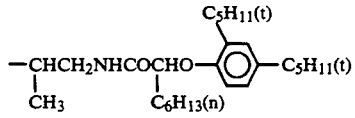 | The same as the above |
| M-16 | The same as the above | 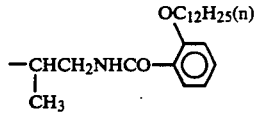 | The same as the above |
| M-17 | The same as the above | 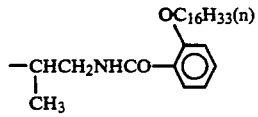 | The same as the above |
| M-18 | 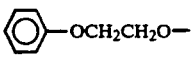 | 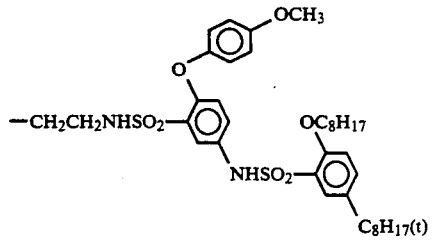 | 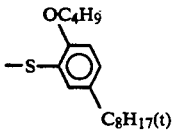 |
| M-19 | $CH_3CH_2O$— | The same as the above | |

-continued
| Compound | $R_{10}$ | $R_{15}$ | $Y_4$ |
|---|---|---|---|
| M-20 | 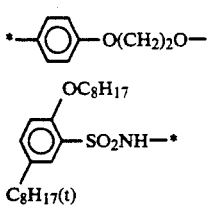 | 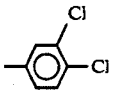 | 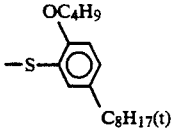 |
| M-21 | 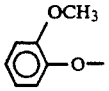 | 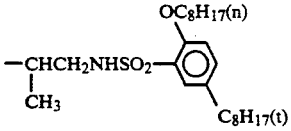 | Cl |
| | | 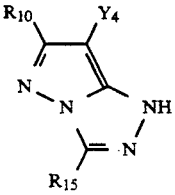 | |
| M-22 | $CH_3$— | 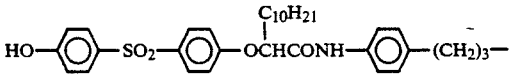 | Cl |
| M-23 | The same as the above | 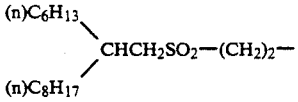 | The same as the above |
| M-24 | 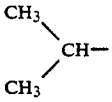 | 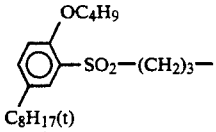 | The same as the above |
| M-25 | 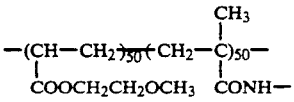 | 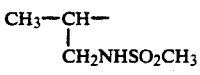 | The same as the above |
| M-26 | 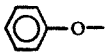 | 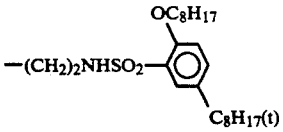 | The same as the above |
| M-27 | $CH_3$— | 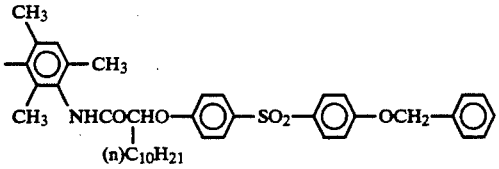 | Cl |
| M-28 | $(CH_3)_3C$— | 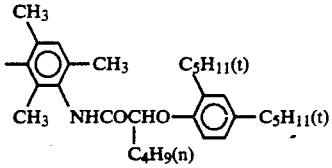 | The same as the above |

-continued
| Compound | $R_{10}$ | $R_{15}$ | $Y_4$ |
|---|---|---|---|
| M-29 | 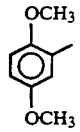 | 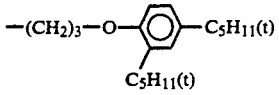 | The same as the above |
| M-30 | $CH_3$— | $-CH(C_2H_5)-N(n\text{-}C_{18}H_{37})COCH_2CH_2COOH$ | The same as the above |
(Y-1)
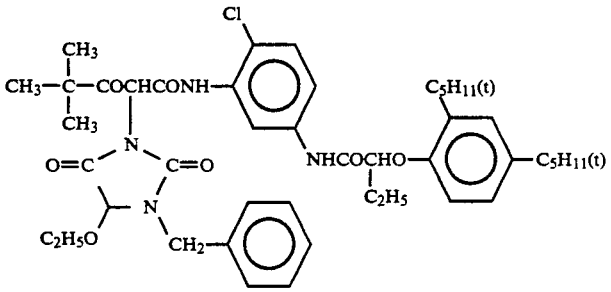
(Y-2)
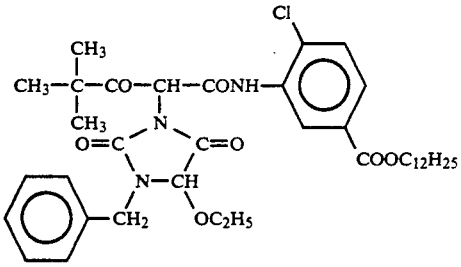
(Y-3)
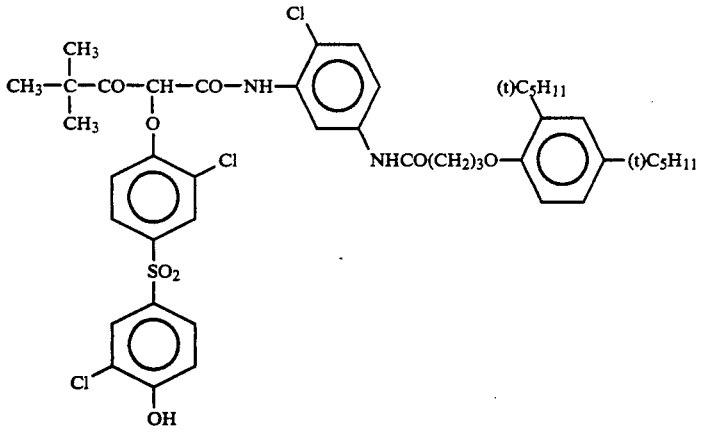
(Y-4)
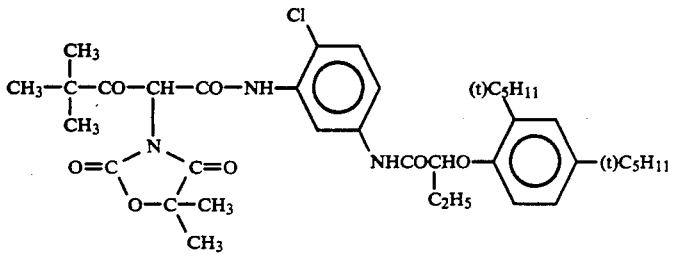

-continued (Y-5)

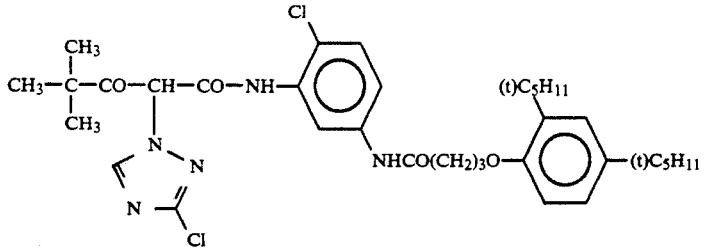

(Y-6)

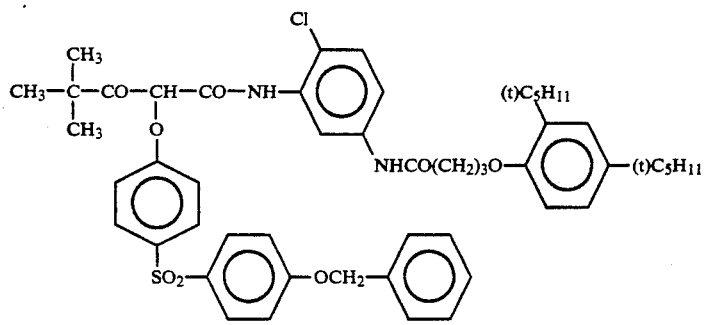

(Y-7)

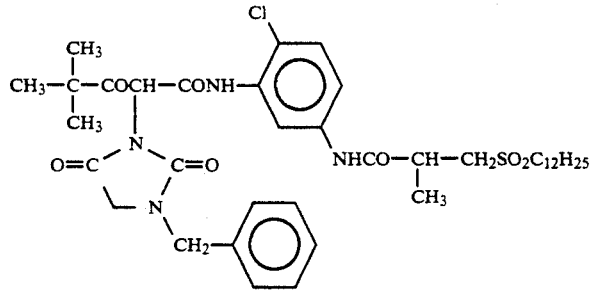

(Y-8)

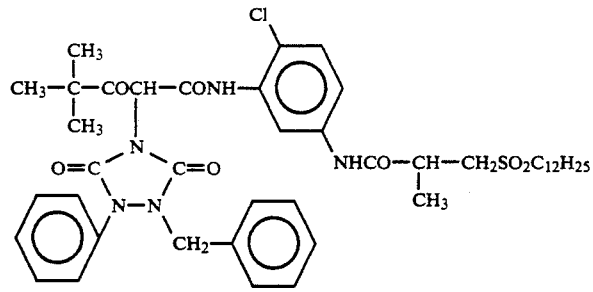

(Y-9)

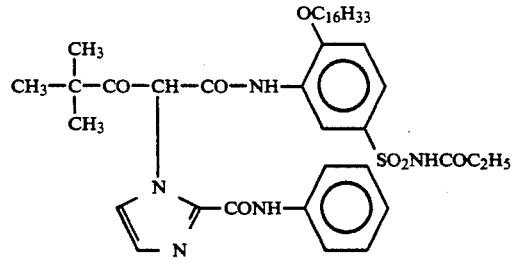

The color photographic material of the present invention may be made by applying on a base at least one blue-sensitive silver halide emulsion layer, at least one green-sensitive silver halide emulsion layer, and at least one red-sensitive silver halide emulsion layer. Generally, in color papers, it is common that the emulsion layers are applied sequentially on the base in the above-stated order, although the order may be different therefrom. An infrared-sensitive silver halide emulsion layer can be used instead of at least one of the above emulsion layers. By incorporating, into the photosensitive emulsion layers, silver halide emulsions sensitive to respective wavelength regions, and dyes complementary to the lights to which they are sensitive, that is, so-called color couplers for forming yellow for blue, magenta for green, and cyan for red, color reproduction of the subtractive color process can be effected. However, the photosensitive layers and the color-forming hues of the couplers may be constituted not to have the above correspondence.

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A'), (B'), (C') (D'), or (E') is preferably used.

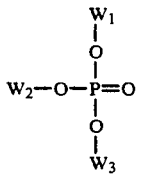
Formula (A')

$W_1-COO-W_2$ Formula (B')

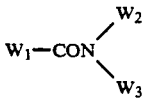
Formula (C')

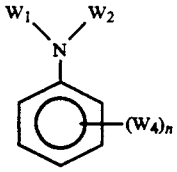
Formula (D')

$W_1-O-W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S-W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 52225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. No. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amide developing agent remaining after the color-developing process so as to form a chemically inactive and substantially colorless compound, and/or a compound (G), which will chemically bond to the oxidized product of the aromatic amide color developing agent remaining after the color-developing process so as to form a chemically inactive and substantially colorless compound, are used simultaneously or separately, so as to prevent the occurrence of stain due to the formation of a color-developed dye by the reaction of the couplers with the color-developing agent remaining in the film during storage after processing or with the oxidized product of the color-developing agent, and to prevent other side effects.

Preferable as compound (F) are those that can react with p-anisidine in a second-order reaction-specific rate $k_2$ (in trioctyl phosphate at 80° C.) in the range of 1.0/mol·sec to $1\times10^{-5}$ /mol·sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if $k_2$ is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those compounds that can be represented by the following formula (FI) or (FII):

$$R_1-(A_1)_n-X \qquad \text{Formula (FI)}$$

-continued $$R_2-\underset{\underset{B_1}{|}}{C}=Y \qquad \text{Formula (FII)}$$

wherein $R_1$ and $R_2$ each represent an aliphatic group, an aromatic group, or a heterocyclic group, n is 1 or 0, $A_1$ represents a group that will react aromatic amine developing agent so as to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_1$ and X, or Y and $R_2$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing so as to form a chemically inactive and colorless compound, can be represented by the following formula (GI):

$$R_3-Z \qquad \text{Formula (GI)}$$

wherein $R_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^nCH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 29145/1987, Japanese Patent Application No. 136724/1988, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making a sharper dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface is preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable. It is preferable to provide a layer of water resistant resin, in particular, a layer of thermoplastic resin. The side opposite to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6$ $\mu m$, and measuring the occupied area ratio (%) (Ri) of the finely divided particles projected onto the unit areas. The deviation coefficient of the occupied area ratio (%) can be obtained based on the ratio $s/\bar{R}$, wherein s stands for the standard deviation of Ri, and $\bar{R}$ stands for the average value of Ri. Preferably, the number (n) of the unit areas to be subjected is 6 or over. Therefore, the deviation coefficient $s/\bar{R}$ can be obtained by $$\sqrt{\frac{\sum_{i=1}^{n}(R_i-\bar{R})^2}{n-1}} \Big/ \frac{\sum_{i=1}^{n} R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the present color photographic material is color-developed, bleach-fixed, and washed (or stabilized). The bleach and the fixing may not be effected in the single bath described above, but may be effected separately.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl-)amino]aniline
D6: 4-amino-3-methyl-N-ethyl-N-[β-(methanesulfonamido)ethyl]-aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that the concentration of sulfite ions is preferably $3.0 \times 10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that the concentration of hydroxylamine is preferably $5.0\times10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

Herein the term "organic preservative" refers to organic compounds that generally, when added to the processing solution for the color -photographic material, reduce the speed of deterioration of the aromatic primary amine color-developing agent. That is, organic preservatives include organic compounds having a function of preventing the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 5355/1988, 43140/1988, 56654/1988, 58346/1988, 43138/1988, 146041/1988, 170642/1988, 44657/1988, and 44656/1988, U.S. Pat. Nos. 3,615,503 and 2,494,903, JP-A No. 143020/1977, and JP-B 30496/1973.

As the other preservative, various metals described, for example, in JP-A Nos. 44148/1982 and 53749/1982, salicylic acids described, for example, in JP-A No. 180588/1984, alkanolamines described, for example, in JP-A No. 3532/1979, polyethyleneimines described, for example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9714/1988, and 11300/1988.

The use of amines in combination with the above-mentioned hydroxylamine derivatives or hydrazine derivatives is preferable in view of stability improvement of the color developer resulting its stability improvement during the continuous processing.

As examples of the above-mentioned amines, there are cyclic amines described, for example, in JP-A No. 239447/1988, amines described, for example, in JP-A No. 128340/1988, and amines described, for example, in Japanese Patent Application Nos. 9713/1988 and 11300/1988.

In the present invention, it is preferable that the color developer contains chloride ions in an amount of $3.5\times10^{-2}$ to $1.5\times10^{-1}$ mol/l, more preferably $4\times10^{-2}$ to $1\times10^{-1}$ mol/l. If the concentration of ions exceeds $1.5\times10^{-1}$ mol/l, it is not preferable since the development is made disadvantageously slow, and does not lead to attainment of the objects of the present invention such as rapid processing and high density. On the other hand, if the concentration of chloride ions is less than $3.5\times10^{-2}$ mol/l, fogging is not prevented.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10^{-3}$ mol/l, the development is slow, the maximum density and the sensitivity are low, and if the concentration of bromide ions is less than $3.0\times10^{-5}$ mol/l, fogging is not prevented sufficiently.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to maintain the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause fogging), and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l, and particularly preferably 0.1 to 0.4 mol/l.

In addition to the color developer can be added various chelating agents to prevent calcium or magnesium from precipitating or to improve the stability of the color developer. As examples of chelating agents can be mentioned nitrilotriacetic acid, diethylenediaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 2380/1969, and 9019/1970, and U.S. Pat. No. 3,813,247; p-phenylenediamine compounds disclosed in JP-A Nos. 9829/1977 and 15554/1975; quaternary ammonium salts disclosed, for example, in JP-A No. 137726/1975, JP-B No. 0074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5 -nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20° to 50° C., and preferably 30° to 40° C. The processing time is 20 sec to 5 min, and preferably 30 sec to 2 min. Although it is preferable that the replenishing amount is as small as possible, it is suitable that the replenishing amount is 20 to 600 ml, preferably 50 to 300 ml, more preferably 60 to 200 ml, and most preferably 60 to 150 ml, per square meter of the photographic material.

The desilvering step in the present invention will now be described. Generally the desilvering step may comprise, for example, any of the following steps: a bleaching step—a fixing step; a fixing step—a bleach-fixing step; a bleaching step—a bleach-fixing step; and a bleach-fixing step.

Next, the bleaching solution, the bleach-fixing solution, and the fixing solution that are used in the present invention will be described.

As the bleaching agent used in the bleaching solution or the bleach-fixing solution used in present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolylphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. The ferric ion complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and *Research Disclosure* No. 17129 (July 1978), thiourea compounds described, for example, in JP-B No. 8506/1970, JP-A Nos. 20832/1977 and 32735/1978, and U.S. Pat. No.

3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can include, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8- octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution contains, as a preservative, sulfites (e.g., sodium sulfite, potassium sulfite, and ammonium sulfite), bisulfites (e.g., ammonium bisulfite, sodium bisulfite, and potassium bisulfite), and metabisulfites (e.g., potassium metabisulfite, sodium metabisulfite, and ammonium metabisulfite). Preferably these compounds are contained in an amount of 0.02 to 0.50 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television Engineers*, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises in that bacteria can propagate due to an increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Bokin Bobai-gakkai), can be used.

Further, the washing water can contain surface-active agents as a water draining agent, and chelating agents such as EDTA as a water softener.

After the washing step mentioned above, or without a washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

Further, chelating agents, such as 1-hydroxyethylidene-1,1-diphosphonic acid, and ethylenediaminetetramethylenephosphonic acid, and magnesium and bismuth compounds can also be used in preferable embodiments.

A so-called rinse can also be used as a washing solution or a stabilizing solution, after desilverization.

The pH of the washing step or a stabilizing step is preferably 4 to 10, more preferably 5 to 8. The temperature will vary depending, for example, on the application and the characteristics of the photographic material, and it generally will be 15° to 45° C., and preferably 20° to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge, and the handleability.

According to the present invention an excellent silver halide photographic material can be provided, that is excellent in rapid processability, that can attain high sensitivity and high contrast, and wherein the fluctuation of sensitivity due to a change of temperature or illuminance at the time of exposure is less, and desensitization that can be caused by application of pressure is less.

Next, the present invention will be described in detail in accordance with examples, but the invention is not limited to these Examples.

EXAMPLE 1

6.4 g of sodium chloride was added to a 3% aqueous solution of lime-treated gelatin, and then 3.2 ml of N,N'-dimethylimidazolidine-2-thion (1% aqueous solution) was added thereto. An aqueous solution containing 0.2 mol of silver nitrate and an aqueous solution containing 0.08 mol of potassium bromide and 0.12 mol of sodium chloride were added at 52° C. to the solution, with strong stirring to mix them. Then, an aqueous solution containing 0.8 mol of silver nitrate and an aqueous solution containing 0.32 mol of potassium bromide and 0.48 mol of sodium chloride were added at 52° C., with strong stirring to mix them. Then, after keeping the mixture at 52° C. for 5 min, desalting and washing were effected. 90.0 g of lime-treated gelatin and then triethyl thiourea were added, to effect chemical sensitization optimally. The thus obtained silver chlorobromide (silver bromide content: 40 mol %) emulsion was named Emulsion A-1.

Then, 3.3 g of sodium chloride was added to a 3 aqueous lime-treated gelatin solution, and 3.2 ml of N,N'-dimethylimidazolidine-2-thion (1% aqueous solution was added thereto. An aqueous solution containing 0.2 mol of silver nitrate and an aqueous solution containing 0.2 mol of sodium chloride were added at 52° C. to the solution, with strong stirring to mix them. Then, an aqueous solution containing 0.8 mol of silver nitrate and an aqueous solution containing 0.8 mol of sodium chloride were added at 52° C., with strong stirring to mix them. Then, after keeping the mixture at 52° C. for 5 min, desalting and washing were effected. 90.0 g of lime-treated gelatin and then triethyl thiourea were added, to effect chemical sensitization optimally. The thus prepared silver chloride emulsion was named Emulsion B-1.

The procedure for Emulsion B-1 was repeated, except that to the first and second aqueous sodium chloride solutions were added respectively 0.84 mg and 3.38 mg of hexacyanoferrate(II) potassium tetrahydrate, the prepared emulsion being named Emulsion B-2.

The procedure for Emulsion B-1 was repeated, except that to the second aqueous sodium chloride solution was added 4.22 mg of hexacyanoferrate(II) potassium tetrahydrate, the prepared emulsion being named Emulsion B-3.

The procedure for Emulsion B-1 was repeated, except that the second aqueous silver nitrate and the second aqueous sodium chloride solution were divided into 3:5, to carry out the addition of silver nitrate/sodium chloride, in three steps, and 4.22 mg of hexacyanoferrate(II) potassium tetrahydrate was added to the third aqueous sodium chloride solution, the prepared emulsion being named Emulsion B-4.

The procedure for Emulsion B-4 was repeated, except that the ratio of the second aqueous silver nitrate solution and aqueous sodium chloride solution to the third aqueous silver nitrate solution and aqueous sodium chloride solution was changed to 1:1, the prepared emulsion being named Emulsion B-5.

The procedure for Emulsion B-4 was repeated, except that the ratio of the second aqueous silver nitrate solution and aqueous sodium chloride solution to the third aqueous silver nitrate solution and aqueous sodium chloride solution was changed to 3:1, the prepared emulsion being named Emulsion B-6.

The procedure for Emulsion B-4 was repeated, except that the ratio of the second aqueous silver nitrate solution and aqueous sodium chloride solution to the third aqueous silver nitrate solution and aqueous sodium chloride solution was changed to 7:1, the prepared emulsion being named Emulsion B-7. The silver halide grains of the thus prepared 8 emulsions were approximately similar and in the form of cubes having an average side length of 0.5 μm, and the deviation coefficient of the grain size was 0.08.

The halogen compositions of these emulsions and the positions of the grains where iron ions were contained are summarized in Table 1.

TABLE 1

| Emulsion | Composition of halogen | Iron (II) ions | Layer containing Iron ions in grain |
|---|---|---|---|
| A-1 | C 60 mol % (Br 40 mol %) | 0 | — |
| B-1 | C 100 mol % | 0 | — |
| B-2 | C 100 mol % | $1 \times 10^{-5}$ mol/mol Ag | Uniformly and wholly contained in a grain |
| B-3 | C 100 mol % | " | surface layer of 80% |
| B-4 | C 100 mol % | " | surface layer of 50% |
| B-5 | C 100 mol % | " | surface layer of 40% |
| B-6 | C 100 mol % | " | surface layer of 20% |
| B-7 | C 100 mol % | " | surface layer of 10% |

Then, 38.0 g of Cyan Coupler (a), 17.0 g of Dye Stabilizer (b), and 35.0 g of Dye Stabilizer (c) were dissolved in 40.0 ml of ethyl acetate and 23.0 ml of Solvent (d), and the solution was emulsified and dispersed in 400 ml of a 10% aqueous gelatin solution containing 20 ml of 10% sodium dodecylbenzenesulfonate.

Spectrally Sensitizing Dyes (e) and (f) were added in respective amounts of $5.0 \times 10^{-5}$ mol/mol Ag and $1.0 \times 10^{-3}$ mol/mol Ag to the previously obtained silver halide emulsions, to produce red-sensitive emulsions, the above coupler emulsified dispersion was mixed with the emulsions, to prepare coating solutions having the compositions shown in Table 2, and the solutions were applied onto paper bases whose opposite surfaces were laminated with polyethylene, thereby producing 8 photographic materials having the layer constitutions shown in Table 2. As a gelatin hardener for the layers, 1-hydroxy-3,5-dichloro-s-triazine sodium salt was used.

TABLE 2

| | | |
|---|---|---|
| Second layer | (Protective layer) | |
| | Gelatin | 1.50 g/m² |
| First layer | (Red-sensitive emulsion layer) | |
| | Silver chloride (bromide) emulsion | 0.24 g/m² (in terms of |

TABLE 2-continued

| | | |
|---|---|---|
| | (A-1, B-1 ~ B-7) | silver) |
| | Cyan coupler (a) | 0.38 g/m$^2$ |
| | Image-dye stabilizer (b) | 0.17 g/m$^2$ |
| | Image-dye stabilizer (c) | 0.35 g/m$^2$ |
| | Solvent (d) | 0.23 m/m$^2$ |
| | Gelatin | 1.00 g/m$^2$ |
| Base | Both-sides polyethylene-laminated support | |

Note: Polyethylene of first layer side contains $TiO_2$ and marine blue.

(a) Cyan coupler

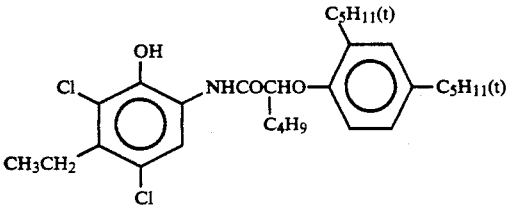

(b) Image-dye stabilizer

Mixture (1:3:3 in molar ratio) of

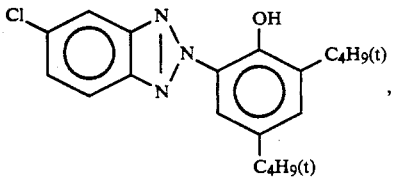

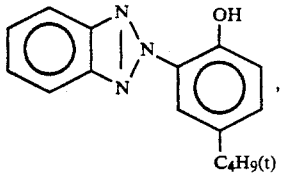

and

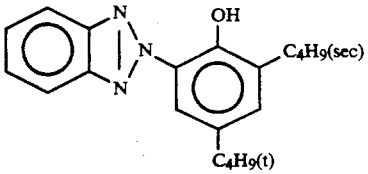

(c) Image-dye stabilizer

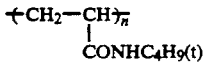

Average molecular weight: 60,000

(d) Solvent

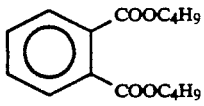

(e) Spectral sensitizer

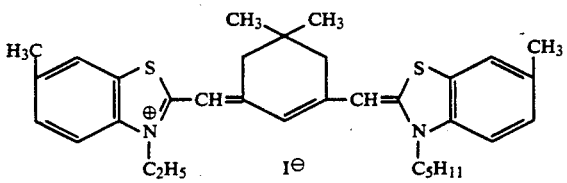

(f)

TABLE 2-continued

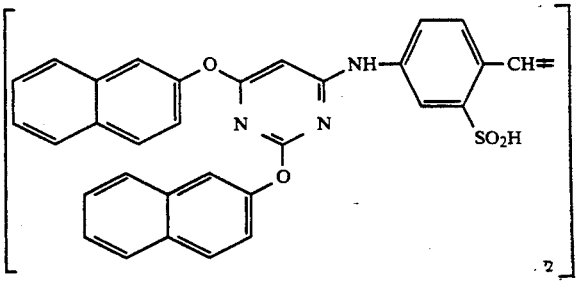

The thus obtained coated samples (named the same as the names of the emulsions used) were used to test the performance of the prepared emulsions.

The samples were exposed to light of 250 CMS at room temperature (24° C.) for 0.1 sec through an optical wedge and a red filter, and were subjected to color development processing using the development steps and developers shown below. The development times 20 sec and 45 sec were compared for the assessment of rapid processability.

To check the fluctuation of the sensitivity due to a change of exposure illuminance, exposure was also effected for 0.01 sec using 250 CMS, followed by development processing.

To see how the photographic performance changes when the temperature of the samples is changed at the time of exposure, the samples were also exposed to light at 15° C. and 35° C., and then development processing was carried out.

The reflection densities of the thus processed samples were measured to obtain the characteristic curves. The reciprocal number of the exposure amount that gave a density higher than the fog density by 0.5 was assumed to be the sensitivity, and the sensitivity was given by the relative value with the sensitivity of Sample A-1 that was exposed for 0.1 sec at room temperature considered to be 100.

The difference between the density corresponding to the exposure amount increased by 0.5 in terms of log E from the exposure amount where the sensitivity was determined, and the density where the sensitivity was determined was defined as contrast.

To check the change at the time when pressure was applied to the photographic materials, the unexposed samples were scratched with a sapphire needle (the curvature diameter of the tip: 0.03 mm), with loads of 2 g, 4 g, 6 g, and 8 g applied to the needle, at a speed of 5 cm/sec, and thereafter they were exposed, developed, and checked for desensitization. The results were assessed as follows:

| Assessment | Degree of desensitization |
|---|---|
| XX | Desensitization was observed with a load of 2 g. |
| X | Desensitization was observed with a load of 4 g. |
| Δ | Desensitization was observed with a load of 6 g. |
| ○ | Desensitization was observed with a load of 8 g. |
| ◎ | Desensitization was not observed, even with a load of 8 g. |

Results are shown in Table 3

TABLE 3

| Processing step | Temperature | Time |
|---|---|---|
| Color development | 35° C. | 20 sec. 45 sec. |
| Bleach-fixing | 35° C. | 45 sec. |
| Rinsing 1 | 30~35° C. | 20 sec. |
| Rinsing 2 | 30~35° C. | 20 sec. |
| Rinsing 3 | 30~35° C. | 20 sec. |
| Rinsing 4 | 30~35° C. | 30 sec. |
| Drying | 70~80° C. | 60 sec. |

Rinsing steps were carried out in 4-tanks counterflow mode from the tank of rinsing 4 towards the rank of rinsing 1.

The compositions of each processing solution were as follows:

| | |
|---|---|
| Color developer | |
| Water | 800 ml |
| Ethylenediamine-N,N,N',N'-tetra-methylene phosphonic acid | 1.5 g |
| Triethylenediamine (1,4-diazobicyclo[2,2,2]octane) | 5.0 g |
| Sodium chloride | 1.4 g |
| Potassium carbonate | 25.0 g |
| N-ethyl-N-(β-methanesulfonamidoethyl)-3-methyl-4-aminoaniline sulfonate | 5.0 g |
| N'N-Diethylhydroxylamine | 4.2 g |
| Fluorescent brightening agent (UVITEX CK, tradename, made by Ciba Gaigy Co.) | 2.0 g |
| Water to make | 1000 ml |
| pH (25° C.) | 10.10 |
| Bleach-fixing solution | |
| Water | 400 ml |
| Ammonium thiosulfate (70%) | 100 ml |
| Sodium sulfite | 18.0 g |
| Iron (III) ammonium ethylenediamine-tetraacetate dihydrate | 55 g |
| Disodium ethylenediaminetetraacetate | 3.0 g |
| Ammonium chloride | 40.0 g |
| Glacial acetic acid | 8.0 g |
| Water to make | 1000 ml |
| pH (25° C.) | 5.50 |

Rinsing solution

Ion-exchanged water (Calcium and magnesium each are contained in an amount of 3 ppm or below)

From the results the remarkable effect of the present invention can be noted. That is, in Sample A-1, using an emulsion having a silver bromide content of 40 mol %, although the sensitivity changes less when the temperature at the time of exposure changes, the development takes a longer time, and the contrast obtained by the processing time in the test is extremely low, so that this emulsion is impracticable.

In contrast, in Sample B-1, using an emulsion having a silver chloride content of 100 mol %, although the developing speed is increased remarkably and high contrast can be obtained even by rapid processing, the sensitivity is too low for this emulsion, to be of practical use. The sensitivity and contrast decreases greatly under high illuminance exposure, and there is great fluctuation of the sensitivity due to a change of temperature at the time of exposure.

By incorporating iron ions into the silver chloride emulsion, although increases in the sensitivity are observed and the fluctuation of sensitivity due to changes of temperature and illuminance at the time of exposure is lessened, for samples using emulsions wherein the iron ions are not concentrated on the grain surfaces, the effect is weak, and desensitization is extreme when the sample undergoes pressure.

Only upon the use of the emulsions wherein iron ions are concentrated in the surface layers, as in the emulsions of the present invention, photographic materials excellent in rapid processability, high in contrast, less in sensitivity fluctuation due to changes of temperature and illuminance at the time of exposure, and excellent in pressure resistance can be obtained.

EXAMPLE 2

6.4 g of sodium chloride was added to a 3% aqueous solution of lime-treated gelatin, and then 3.8 ml of N,N'-dimethylimidazolidine-2-thion (1% aqueous solution) was added thereto. An aqueous solution containing 0.2 mol of silver nitrate and an aqueous solution containing 0.08 mol of potassium bromide and 0.12 mol of sodium chloride were added at 66° C. to the solution, with strong stirring to mix them. Then, an aqueous solution containing 0.8 mol of silver nitrate and an aqueous solution containing 0.32 mol of potassium bromide and 0.48

TABLE 3A

| | Room temperature (24° C.) | | | | | | | | |
|---|---|---|---|---|---|---|---|---|---|
| | 0.1 sec. exposure | | | | 0.01 sec. exposure | | Sensitivity difference | Reduced | |
| | 20 sec. development | | 45 sec. development | | 45 sec development | | between 15° C. and 35° C. | sensitivity due to | |
| Sample | $S^1$ | $C^2$ | $S^1$ | $C^2$ | $S^1$ | $C^2$ | exposure | pressure | Remarks |
| A-1 | 25 | 0.41 | 100 | 0.78 | 63 | 0.56 | +3 | ◎ | Comparative example |
| B-1 | 34 | 0.86 | 52 | 0.89 | 32 | 0.48 | +31 | ◎ | Comparative example |
| B-2 | 49 | 1.03 | 73 | 1.07 | 53 | 0.87 | +18 | x | Comparative example |
| B-3 | 55 | 1.08 | 85 | 0.12 | 68 | 0.91 | +11 | x | Comparative example |
| B-4 | 83 | 1.36 | 118 | 1.39 | 97 | 1.28 | +8 | Δ~○ | This invention |
| B-5 | 101 | 1.38 | 135 | 1.41 | 114 | 1.32 | +5 | ○ | This invention |
| B-6 | 122 | 1.43 | 168 | 1.45 | 136 | 1.37 | +5 | ○ | This invention |
| B-7 | 134 | 1.45 | 173 | 1.48 | 149 | 1.42 | +4 | ◎ | This invention |

Note
$S^1$: sensitivity
$C^2$: contrast mol of sodium chloride were added at 66° C., with strong stirring to mix them. Then, after keeping the mixture at 66° C. for 5 min, the temperature was lowered and desalting and washing were effected. 90.0 g of lime-treated gelatin was added, and after adjusting the pH and pAg, Spectrally Sensitizing Dye (g) in an amount of $3.0\times10^{-4}$ mol per mol of the silver halide and triethyl thiourea in an amount of $1.0\times10^{-5}$ mol per mol of the silver halide were added, to effect spectral sensitization and chemical sensitization. The thus obtained silver chlorobromide (silver bromide content: 40 mol %) emulsion was named Emulsion B-201.

Next, 3.3 g of sodium chloride was added to a 3% aqueous solution of lime-treated gelatin, and then 3.2 ml of N,N'-dimethylimidazolidine-2-thion (1% aqueous solution) was added thereto. An aqueous solution containing 0.2 mol of silver nitrate and an aqueous solution containing 0.04 mol of potassium bromide and 0.16 mol of sodium chloride were added at 66° C. to the solution, with strong stirring to mix them. Then, an aqueous solution containing 0.8 mol of silver nitrate and an aqueous solution containing 0.16 mol of potassium bromide and 0.64 mol of sodium chloride were added at 66° C., with strong stirring to mix them. Then, after keeping the mixture at 66° C. for 5 min, the temperature was lowered and desalting and washing were effected. 90.0 g of lime-treated gelatin was then added, and after adjusting the pH and pAG, similarly to Emulsion B-201, Spectrally Sensitizing Dye (g) and triethyl thiourea were added to effect spectral sensitization and chemical sensitization. The thus obtained silver chlorobromide (silver bromide content: 20 mol %) emulsion was named Emulsion B-202.

Next, 3.3 g of sodium chloride was added to a 3 aqueous solution of lime-treated gelatin, and then 3.2 ml of N,N'-dimethylimidazolidine-2-thion (1% aqueous solution) was added thereto. An aqueous solution containing 0.2 mol of silver nitrate and an aqueous solution containing 0.04 mol of potassium bromide and 0.196 mol of sodium chloride were added at 66° C. to the solution, with strong stirring to mix them. Then, an aqueous solution containing 0.8 mol of silver nitrate and an aqueous solution containing 0.016 mol of potassium bromide and 0.786 mol of sodium chloride were added at 66° C., with strong stirring to mix them. Then, after keeping the mixture at 66° C. for 5 min, the temperature was lowered and desalting and washing were effected. 90.0 g of lime-treated gelatin was then added, and after adjusting the pH and pAG, similarly to Emulsion B-201, Spectrally Sensitizing Dye (g) and triethyl thiourea were added to effect spectral sensitization and chemical sensitization. The thus obtained silver chlorobromide (silver bromide content: 2 mol %) emulsion was named Emulsion B-203.

The procedure for Emulsion B-203 was repeated, except that 0.42 mg and 1.69 mg of hexacyanoferrate(II) potassium tetrahydrate were respectively added to the first and second aqueous alkali halide solutions, the thus prepared emulsion being named Emulsion B-204.

Then, the procedure for Emulsion B-203 was repeated, except that the second aqueous silver nitrate solution and aqueous alkali halide solution were divided into 3:1, to carry out the addition of silver nitrate/alkali halide, in three steps, and 2.11 mg of hexacyanoferrate(II) potassium tetrahydrate was added to the third aqueous alkali halide solution, the thus prepared emulsion being named Emulsion B-205.

The procedure for Emulsion B-203 was repeated, except that the second aqueous silver nitrate solution and aqueous alkali halide solution were divided into 7:1, to carry out the addition of silver nitrate/alkali halide, in three steps, and 0.234 mg, 0.821 mg, and 1.055 mg of hexacyanoferrate(II) potassium tetrahydrate were respectively added to the first, second, and third aqueous alkali halide solutions, the thus prepared emulsion being named Emulsion B-206. In the preparation of these emulsion grains, the supply of the reaction solutions was carried out in three steps, and if the grains are considered to be divided into an outermost surface layer, where the iron ion concentration is higher, and a core part in the outermost surface layer, the surface layer rate of the emulsion grains is 10%, and the iron ion concentration of the surface layer is 9.0 times that of the grain core part.

Then, the procedure for Emulsion B-205 was repeated, except that the ratio of the second aqueous silver nitrate solution and aqueous alkali halide solution to the third aqueous silver nitrate solution and aqueous alkali halide solution was changed to 7:1, the thus prepared emulsion being named Emulsion B-207.

Next, 3.3 g of sodium chloride was added to a 3% aqueous solution of lime-treated gelatin, and then 3.2 ml of N,N'-dimethylimidazolidine-2-thion (1% aqueous solution) was added thereto. An aqueous solution containing 0.2 mol of silver nitrate and an aqueous solution containing 0.2 mol of sodium chloride were added at 66° C. to the solution, with strong stirring to mix them. Then, an aqueous solution containing 0.7 mol of silver nitrate and an aqueous solution containing 0.7 mol of sodium chloride were added at 66° C., with strong stirring to mix them. Further, an aqueous solution containing 0.1 mol of silver nitrate and an aqueous solution containing 2.11 mg of hexacyanoferrate(II) potassium tetrahydrate and 0.1 mol of sodium chloride were added at 66° C., with strong stirring to mix them. Then, after keeping the mixture at 66° C. for 5 min, the temperature was lowered and desalting and washing were effected. 90.0 g of lime-treated gelatin was then added, and after adjusting the pH and pAG, Spectrally Sensitizing Dye (g) and a silver bromide fine grain emulsion (average grain size: 0.05 μm) in an amount corresponding to 2 mol % for the silver halide and triethyl thiourea were added, to effect spectral sensitization and chemical sensitization. The thus obtained silver chloride emulsion was named Emulsion B-208.

Next, 3.3 g of sodium chloride was added to a 3% aqueous solution of lime-treated gelatin, and then 3.2 m of N,N'-dimethylimidazolidine-2-thion (1% aqueous solution) was added thereto. An aqueous solution containing 0.2 mol of silver nitrate and an aqueous solution containing 0.2 mol of sodium chloride were added to the solution at 66° C., with strong stirring to mix them. Then, an aqueous solution containing 0.8 mol of silver nitrate and an aqueous solution containing 0.8 mol of sodium chloride were added at 66° C., with strong stirring to mix them. Then, after keeping the mixture at 66° C. for 5 min, the temperature was lowered and desalting and washing were effected. Further, 90.0 g of lime-treated gelatin was then added, and after adjusting the pH and pAG, Spectrally Sensitizing Dye (g) and triethyl thiourea were added to effect spectral sensitization and chemical sensitization. The thus obtained silver chloride emulsion was named Emulsion B-209.

The procedure for Emulsion B-209 was repeated, except that 0.42 mg and 1.69 mg of hexacyanoferrate(II)

potassium tetrahydrate were respectively added to the first and second aqueous sodium chloride solutions, the thus prepared emulsion being named Emulsion B-210.

The procedure for Emulsion B-209 was repeated, except that the second aqueous silver nitrate solution and aqueous sodium chloride solution were divided into 7:1, to carry out the addition of silver nitrate/sodium chloride, in three steps, and 0.234 mg, 0.821 mg, and 1.055 mg of hexacyanoferrate(II) potassium tetrahydrate were respectively added to the first, second, and third aqueous sodium chloride solutions, the thus prepared emulsion being named Emulsion B-211. In the preparation of the particular emulsion grains, the supply of the reaction solutions was carried out in three steps, and if the grains are considered to be divided into an outermost surface layer where the iron ion concentration is higher, and a core part in the outermost surface layer, the surface layer rate of the emulsion grains is 10%, and the iron ion concentration of the surface layer is 9.0 times that of the grain core part.

Then, the procedure for Emulsion B-211 was repeated, except that 2.11 mg of hexacyanoferrate(II) potassium tetrahydrate was added only to the third aqueous sodium chloride solution, the thus prepared emulsion being named Emulsion B-212.

The above procedures for these emulsions were repeated, except that the temperature at the time when the silver halide emulsion grains were formed and the speed of the addition of the reaction solutions were changed, so that emulsions having an average grain size of about 0.46 μm might be prepared, the spectrally sensitizing dye was changed to Spectrally Sensitizing Dye (h), mentioned below, and the amount of added hexacyanoferrate(II) potassium tetrahydrate was doubled, the thus prepared emulsions being named Emulsions G-201 to G-212.

The above procedures for Emulsions G-201 to G-212 were repeated, except that the temperature at the time when the silver halide emulsion grains were formed and the speed of the addition of the reaction solutions were changed, so that emulsions having an average grain size of about 0.53 μm might be prepared, and the spectrally sensitizing dye was changed to Spectrally Sensitizing Dyes (e) and (f) of Example 1, the thus prepared emulsions being named Emulsions R-201 to R-212.

The halogen compositions of these emulsions, the grain sizes, and the positions of the parts of the grains where iron ions were contained are summarized in Table 4. With respect to the three Emulsions B-208, G-208, and R-208 out of these emulsions, halogen composition analysis was carried out by the X-ray diffraction method, and it was found that, in addition to the main peak of 100 mol % of silver chloride, a secondary peak corresponding to a silver bromide content of 30 to 40 mol % was observed, showing that these emulsion grains had silver bromide localized phases.

These emulsions thus prepared were layered to prepare 12 color photographic materials with the compositions, the layer constitutions, and the combinations of emulsions shown in Tables 5 and 6. Preparation of the coating liquids was carried out as follows.

The First Layer Coating Solution 27.2 ml of ethyl acetate and 7.9 ml of Solvent (d) were added to 19.1 g of Yellow Coupler (i), 4.4 g of Dye Stabilizer (j), and 0.7 g of Dye Stabilizer (c) to dissolve them, and the solution was emulsified and dispersed into 200 ml of a 10% aqueous gelatin solution containing 8.0 ml of 10% sodium dodecylbenzenesulfonate.

The thus obtained emulsified dispersion of the coupler and the silver halide emulsion shown in Table 6 were mixed and dissolved, to form the composition shown in Table 5, thereby preparing the first layer coating solution.

Similarly to the method for the preparation of the first coating solution, the second to the seventh layer coating solutions were prepared. However, in the case of the emulsified dispersion used in the fifth layer, after the emulsifying and dispersing operation, the ethyl acetate was distilled off at 40° C. under reduced pressure.

As the gelatin hardener, the same compound used in Example 1 was used.

TABLE 4

| Emulsion | Halogen Composition (mol %) | Grain Size (μm) | Grain Deviation Coefficient | Grain Shape | AgBr Localized Phase | Iron (II) Ions (mol/mol Ag) |
|---|---|---|---|---|---|---|
| B 201 | Cl:60 (Br:40) | 0.96 | 0.08 | Cubic | None | 0 |
| B 202 | Cl:80 (Br:20) | 0.97 | 0.07 | Cubic | None | 0 |
| B 203 | Cl:98 (Br:2) | 0.97 | 0.07 | Cubic | None | 0 |
| B 204 | Cl:98 (Br:2) | 0.97 | 0.07 | Cubic | None | $5 \times 10^{-6}$ |
| B 205 | Cl:98 (Br:2) | 0.97 | 0.07 | Cubic | None | $5 \times 10^{-6}$ |
| B 206 | Cl:98 (Br:2) | 0.97 | 0.07 | Cubic | None | $5 \times 10^{-6}$ |
| B 207 | Cl:98 (Br:2) | 0.97 | 0.07 | Cubic | None | $5 \times 10^{-6}$ |
| B 208 | Cl:98 (Br:2) | 0.97 | 0.07 | Cubic | Present | $5 \times 10^{-6}$ |
| B 209 | Cl:100 | 0.95 | 0.07 | Cubic | None | 0 |
| B 210 | Cl:100 | 0.95 | 0.07 | Cubic | None | $5 \times 10^{-6}$ |
| B 211 | Cl:100 | 0.95 | 0.07 | Cubic | None | $5 \times 10^{-6}$ |
| B 212 | Cl:100 | 0.95 | 0.07 | Cubic | None | $5 \times 10^{-6}$ |
| G 201 | Cl:60 (Br:40) | 0.45 | 0.08 | Cubic | None | 0 |
| G 202 | Cl:80 (Br:20) | 0.46 | 0.07 | Cubic | None | 0 |
| G 203 | Cl:98 (Br:2) | 0.47 | 0.07 | Cubic | None | 0 |
| G 204 | Cl:98 (Br:2) | 0.47 | 0.07 | Cubic | None | $1 \times 10^{-5}$ |
| G 205 | Cl:98 (Br:2) | 0.47 | 0.07 | Cubic | None | $1 \times 10^{-5}$ |
| G 206 | Cl:98 (Br:2) | 0.47 | 0.07 | Cubic | None | $1 \times 10^{-5}$ |
| G 207 | Cl:98 (Br:2) | 0.47 | 0.07 | Cubic | None | $1 \times 10^{-5}$ |
| G 208 | Cl:98 (Br:2) | 0.47 | 0.07 | Cubic | Present | $1 \times 10^{-5}$ |
| G 209 | Cl:100 | 0.46 | 0.07 | Cubic | None | 0 |
| G 210 | Cl:100 | 0.46 | 0.07 | Cubic | None | $1 \times 10^{-5}$ |
| G 211 | Cl:100 | 0.46 | 0.07 | Cubic | None | $1 \times 10^{-5}$ |
| G 212 | Cl:100 | 0.46 | 0.07 | Cubic | None | $1 \times 10^{-5}$ |
| R 201 | Cl:60 (Br:40) | 0.53 | 0.08 | Cubic | None | 0 |
| R 202 | Cl:80 (Br:20) | 0.52 | 0.07 | Cubic | None | 0 |
| R 203 | Cl:98 (Br:2) | 0.54 | 0.07 | Cubic | None | 0 |

TABLE 4-continued

| | | | | | | |
|---|---|---|---|---|---|---|
| R 204 | Cl:98 (Br:2) | 0.54 | 0.07 | Cubic | None | $1 \times 10^{-5}$ |
| R 205 | Cl:98 (Br:2) | 0.54 | 0.07 | Cubic | None | $1 \times 10^{-5}$ |
| R 206 | Cl:98 (Br:2) | 0.54 | 0.07 | Cubic | None | $1 \times 10^{-5}$ |
| R 207 | Cl:98 (Br:2) | 0.54 | 0.07 | Cubic | None | $1 \times 10^{-5}$ |
| R 208 | Cl:98 (Br:2) | 0.54 | 0.07 | Cubic | Present | $1 \times 10^{-5}$ |
| R 209 | Cl:100 | 0.53 | 0.07 | Cubic | None | 0 |
| R 210 | Cl:100 | 0.53 | 0.07 | Cubic | None | $1 \times 10^{-5}$ |
| R 211 | Cl:100 | 0.53 | 0.07 | Cubic | None | $1 \times 10^{-5}$ |
| R 212 | Cl:100 | 0.53 | 0.07 | Cubic | None | $1 \times 10^{-5}$ |

| Emulsion | Layer containing Iron ions in a Grain | Sensitizing Dye Amount (mol/mol Ag) |
|---|---|---|
| B 201 | — | (g) ($3 \times 10^{-4}$) |
| B 202 | — | (g) ($3 \times 10^{-4}$) |
| B 203 | — | (g) ($3 \times 10^{-4}$) |
| B 204 | Uniformly contained in a grain | (g) ($3 \times 10^{-4}$) |
| B 205 | Surface Layer of 20% | (g) ($3 \times 10^{-4}$) |
| B 206 | Core and Surface Layer of 10% | (g) ($3 \times 10^{-4}$) |
| B 207 | Surface Layer of 10% | (g) ($3 \times 10^{-4}$) |
| B 208 | Surface Layer of 10% | (g) ($3 \times 10^{-4}$) |
| B 209 | — | (g) ($3 \times 10^{-4}$) |
| B 210 | Uniformly contained in a grain | (g) ($3 \times 10^{-4}$) |
| B 211 | Surface Layer of 10% | (g) ($3 \times 10^{-4}$) |
| B 212 | Surface Layer of 10% | (g) ($3 \times 10^{-4}$) |
| G 201 | — | (h) ($4 \times 10^{-4}$) |
| G 202 | — | (h) ($4 \times 10^{-4}$) |
| G 203 | — | (h) ($4 \times 10^{-4}$) |
| G 204 | Uniformly contained in a grain | (h) ($4 \times 10^{-4}$) |
| G 205 | Surface Layer of 20% | (h) ($4 \times 10^{-4}$) |
| G 206 | Core and Surface Layer of 10% | (h) ($4 \times 10^{-4}$) |
| G 207 | Surface Layer of 10% | (h) ($4 \times 10^{-4}$) |
| G 208 | Surface Layer of 10% | (h) ($4 \times 10^{-4}$) |
| G 209 | — | (h) ($4 \times 10^{-4}$) |
| G 210 | Uniformly contained in a grain | (h) ($4 \times 10^{-4}$) |
| G 211 | Surface Layer of 10% | (h) ($4 \times 10^{-4}$) |
| G 212 | Surface Layer of 10% | (h) ($4 \times 10^{-4}$) |
| R 201 | — | (e) ($5 \times 10^{-5}$) and (f) ($1 \times 10^{-3}$) |
| R 202 | — | (e) ($5 \times 10^{-5}$) and (f) ($1 \times 10^{-3}$) |
| R 203 | — | (e) ($5 \times 10^{-5}$) and (f) ($1 \times 10^{-3}$) |
| R 204 | Uniformly contained in a grain | (e) ($5 \times 10^{-5}$) and (f) ($1 \times 10^{-3}$) |
| R 205 | Surface Layer of 20% | (e) ($5 \times 10^{-5}$) and (f) ($1 \times 10^{-3}$) |
| R 206 | Core and Surface Layer of 10% | (e) ($5 \times 10^{-5}$) and (f) ($1 \times 10^{-3}$) |
| R 207 | Surface Layer of 10% | (e) ($5 \times 10^{-5}$) and (f) ($1 \times 10^{-3}$) |
| R 208 | Surface Layer of 10% | (e) ($5 \times 10^{-5}$) and (f) ($1 \times 10^{-3}$) |
| R 209 | — | (e) ($5 \times 10^{-5}$) and (f) ($1 \times 10^{-3}$) |
| R 210 | Uniformly contained in a grain | (e) ($5 \times 10^{-5}$) and (f) ($1 \times 10^{-3}$) |
| R 211 | Surface Layer of 10% | (e) ($5 \times 10^{-5}$) and (f) ($1 \times 10^{-3}$) |
| R 212 | Surface Layer of 10% | (e) ($5 \times 10^{-5}$) and (f) ($1 \times 10^{-3}$) |

TABLE 5

| Layer | Main Component | | Amount used (g/m²) |
|---|---|---|---|
| 7th Layer (protective layer) | Gelatin | | 1.33 |
| | Acryl-modified poly(vinyl alcohol) (Modification degree: 17%) | | 0.17 |
| | Liquid paraffin | | 0.03 |
| 6th Layer (UV absorbing layer) | Gelatin | | 0.53 |
| | UV-absorber | (s) | 0.16 |
| | Solvent | (t) | 0.08 |
| 5th Layer (Red-sensitive emulsion layer) | Silver halide emulsion (see Table 6) | | 0.23 |
| | Gelatin | | 1.34 |
| | Cyan coupler | (u) | 0.32 |
| | Image-dye stabilizer | (b) | 0.17 |
| | | (c) | 0.40 |
| | | (v) | 0.04 |
| | Solvent | (w) | 0.15 |
| 4th Layer (UV-absorbing layer) | Gelatin | | 1.58 |
| | UV-absorber | (s) | 0.47 |
| | Color mixing inhibitop | (k) | 0.05 |
| | Solvent | (t) | 0.24 |
| 3rd Layer (Green-sensitive layer) | Silver halide emulsion (see Table 6) | | 0.12 |
| | Gelatin | | 1.24 |
| | Magenta coupler | (m) | 0.20 |
| | Image-dye stabilizer | (n) | 0.03 |
| | | (o) | 0.15 |
| | | (p) | 0.02 |
| | | (q) | 0.02 |
| | Solvent | (r) | 0.40 |
| 2nd Layer (Color-mix preventing layer) | Gelatin | | 0.99 |
| | Color mixing inhibitop | (k) | 0.08 |
| | Solvent | (d) | 0.16 |
| | | (l) | 0.08 |
| 1st Layer | Silver halide emulsion (see Table 6) | | 0.30 |
| | Gelatin | | 1.86 |
| | Yellow coupler | (i) | 0.82 |
| | Image-dye stabilizer | (j) | 0.19 |
| | | (c) | 0.06 |
| | Solvent | (d) | 0.35 |
| Supporting base | Polyethylene-laminated paper ($TiO_2$ and marrine blue are included in the 1st layer side poltethylene) | | |

Compounds used are as follows:

(g) Spectral sensitizer
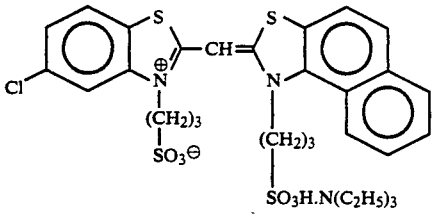
(h) Spectral sensitizer
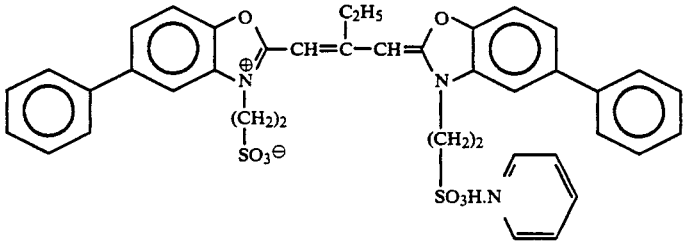
Mixture (1:1 in molar ratio) of
(i) Yellow coupler
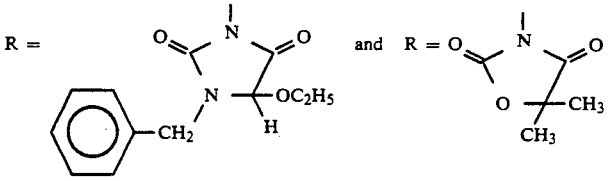
of the following formula
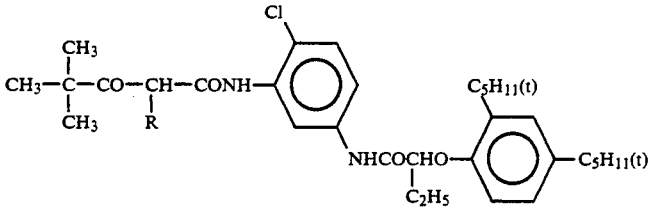
(j) Image-dye stabilizer
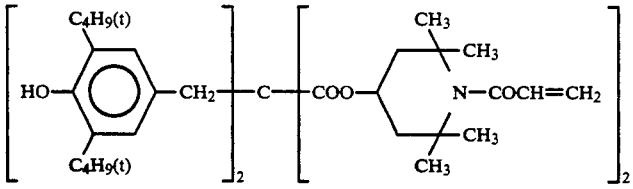
(k) Color-mix inhibitor
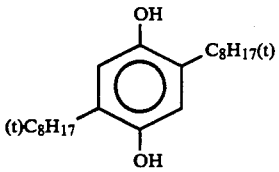
(l) Solvent
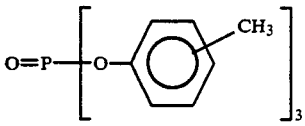
Mixture (1:1 in molar ratio) of -continued
(m) Magenta coupler
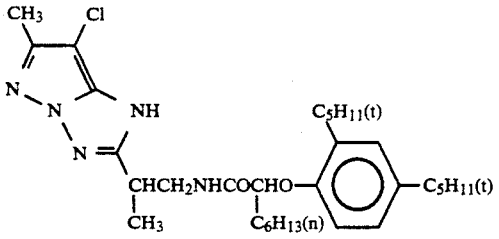
and
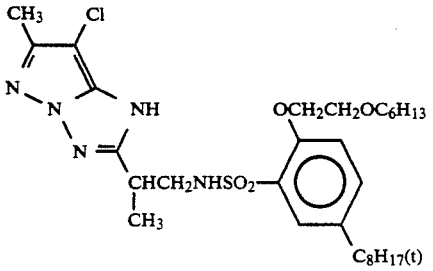
(n) Image-dye stabilizer
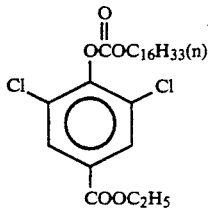
(o) Image-dye stabilizer
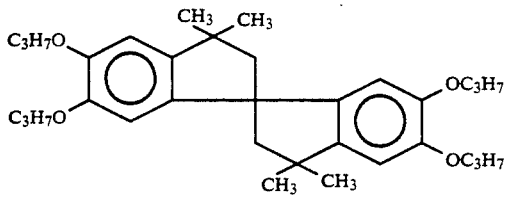
(p) Image-dye stabilizer
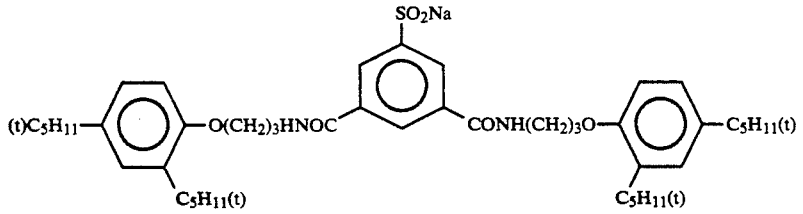
(q) Image-dye stabilizer
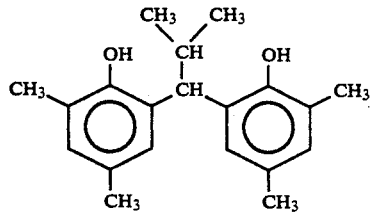
Mixture (2:1 in volume ratio) of
(r) Solvent
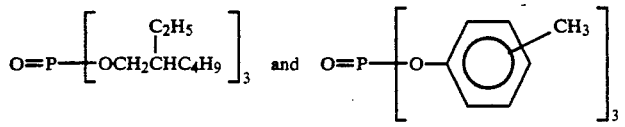
Mixture (4:2:4 in weight ratio) of -continued
(s) UV absorber
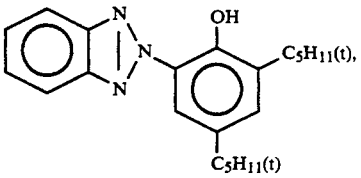
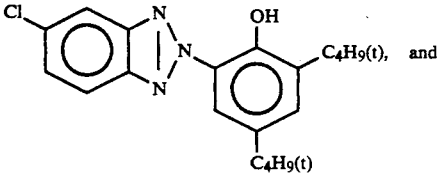
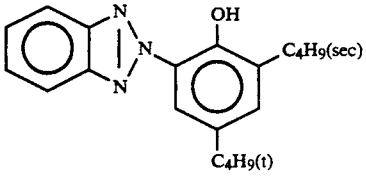
(t) Solvent
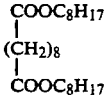
Mixture (2:4:4 in weight ratio) of
R = $C_2H_5$ and $C_4H_9$ of
(u) Cyan coupler
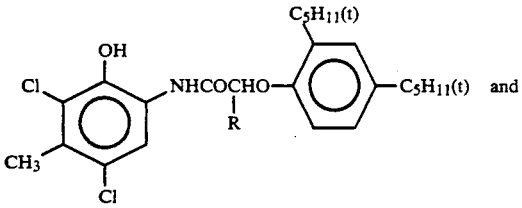
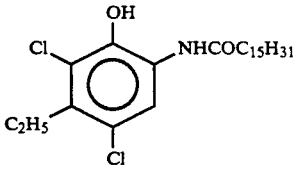
Mixture (1:1 in weight ratio) of
(v) Image-dye stabilizer
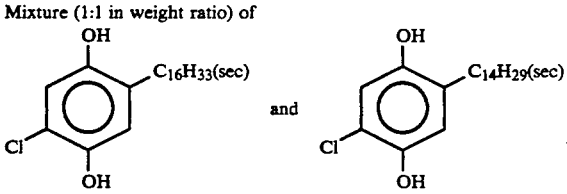
(w) Solvent
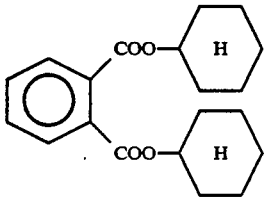

TABLE 6

| Sample | Blue-sensitive emulsion layer | Green sensitive emulsion layer | Red-sensitive emulsion layer |
|---|---|---|---|
| 201 | B-201 | G-201 | R-201 |
| 202 | B-202 | G-202 | R-202 |
| 203 | B-203 | G-203 | R-203 |
| 204 | B-204 | G-204 | R-204 |
| 205 | B-205 | G-205 | R-205 |
| 206 | B-206 | G-206 | R-206 |
| 207 | B-207 | G-207 | R-207 |
| 208 | B-208 | G-208 | R-208 |
| 209 | B-209 | G-209 | R-209 |
| 210 | B-210 | G-210 | R-210 |
| 211 | B-211 | G-211 | R-211 |
| 212 | B-212 | G-212 | R-212 |

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion layer and the green-sensitive emulsion layer in amount of $1\times10^{-4}$ mol, $2\times10^{-4}$ mol, per mol of silver halide, respectively.

The dyes shown below were added to the emulsion layers for prevention of irradiation.

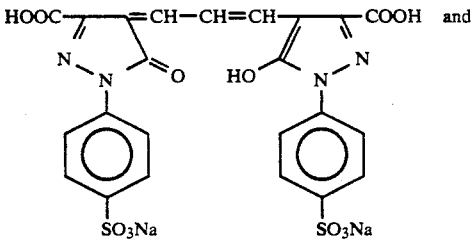

and

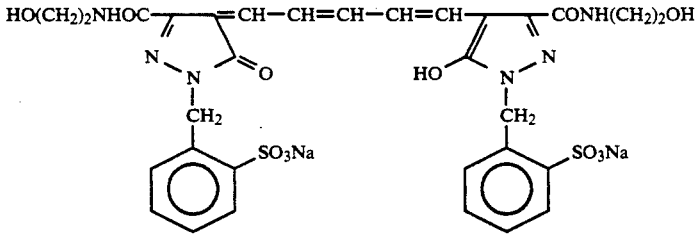

The 12 types of the thus obtained coated samples were tested similarly to Example 1, in which testing the exposure of the samples to light was made through blue, green, and red filters, thereby checking the performance of each of the blue-sensitive, green-sensitive, and red-sensitive photosensitive emulsion layers.

For the development processing of the samples, the following processing steps and processing solutions were used. The results are shown in Table 7.

| Processing step | Temperature | Time | Replenisher* | Tank volume |
|---|---|---|---|---|
| Color development | 35° C. | 20 sec, 45 sec | 161 ml | 17 l |
| Bleach-fixing | 30–35° C. | 45 sec. | 215 ml | 17 l |

-continued

| Processing step | Temperature | Time | Replenisher* | Tank volume |
|---|---|---|---|---|
| Rinsing (1) | 30–35° C. | 20 sec | — | 10 l |
| Rinsing (2) | 30–35° C. | 20 sec | — | 10 l |
| Rinsing (3) | 30–35° C. | 20 sec | 350 ml | 10 l |
| Drying | 70–80° C. | 60 sec | | |

Note:
*The replenishing amount was per 1 $m^2$ of the photographic material. (The rinsing was a three-tank counter current system of the tank of rinsing (3) towards the tank of rinsing (1).)

| | Tank Solution | Replenisher |
|---|---|---|
| Color developer | | |
| Water | 800 ml | 800 ml |
| Ethylenediamine-N,N,N',N'-tetramethylenephosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidoethyl)-3-methyl-4-aminoaniline sulfonate | 5.0 g | 7.0 g |
| N,N-bis(carboxymethyl)hydrazine | 5.5 g | 7.0 g |
| Fluorescent brightening agent (WHITEX-4B, made by Sumitomo Chemical Ind. Co.) | 1.0 g | 2.0 g |
| Water to make | 1000 ml | 1000 ml |
| pH (25° C.) | 10.05 | 10.45 |

| Bleach-fixing solution (Both tank solution and replenisher) | |
|---|---|
| Water | 400 ml |
| Ammonium thiosulfate (70%) | 100 ml |
| Sodium sulfite | 17 g |
| Iron (III) ammonium ethylenediaminetetraacetate dihydrate | 55 g |
| Disodium ethylenediaminetetraacetate | 5 g |
| Ammonium bromide | 40 g |
| Water to make | 1000 ml |
| pH (25° C.) | 6.0 |

Rinsing solution (Both tank solution and replenisher) Ion-exchanged water (Calcium and magnesium each are contained in an amount of 3 ppm or below)

TABLE 7

| Sample | | Room temperature (24° C.) 0.1 sec. exposure 20 sec. development S[1] | C[2] | 45 sec. development S[1] | C[2] | 0.01 sec. exposure 45 sec development S[1] | C[2] | Sensitivity difference between 15° C. and 35° C. exposure | Reduced sensitivity due to pressure | Remarks |
|---|---|---|---|---|---|---|---|---|---|---|
| 201 | B | 13 | 0.32 | 100 | 0.65 | 61 | 0.48 | +3 | ◎ | Comparative |
| | G | 22 | 0.39 | 100 | 0.72 | 65 | 0.54 | +2 | ◎ | example |
| | R | 24 | 0.40 | 100 | 0.77 | 64 | 0.57 | +4 | ◎ | |
| 202 | B | 31 | 0.35 | 77 | 0.67 | 47 | 0.44 | +7 | ◎ | Comparative |
| | G | 40 | 0.44 | 79 | 0.74 | 52 | 0.48 | +7 | ◎ | example |
| | R | 38 | 0.48 | 75 | 0.80 | 49 | 0.52 | +9 | ◎ | |
| 203 | B | 43 | 0.77 | 66 | 0.86 | 41 | 0.44 | +19 | ◎ | Comparative |
| | G | 45 | 0.81 | 70 | 0.87 | 45 | 0.48 | +21 | ◎ | example |
| | R | 38 | 0.83 | 55 | 0.88 | 34 | 0.52 | +28 | ◎ | |
| 204 | B | 61 | 0.79 | 92 | 0.91 | 63 | 0.74 | +11 | x | Comparative |
| | G | 64 | 0.87 | 98 | 0.91 | 72 | 0.75 | +13 | x | example |
| | R | 51 | 0.93 | 76 | 1.02 | 55 | 0.84 | +16 | x | |
| 205 | B | 135 | 1.17 | 192 | 1.25 | 157 | 1.19 | +4 | ○ | This |
| | G | 144 | 1.21 | 203 | 1.31 | 165 | 1.25 | +4 | ○ | invention |
| | R | 127 | 1.35 | 178 | 1.46 | 145 | 1.38 | +5 | ○ | |
| 206 | B | 98 | 0.95 | 133 | 1.09 | 102 | 1.02 | +7 | x | Comparative |
| | G | 101 | 1.01 | 136 | 1.11 | 105 | 1.02 | +8 | x | example |
| | R | 92 | 1.15 | 128 | 1.26 | 99 | 1.16 | +10 | x | |
| 207 | B | 145 | 1.19 | 198 | 1.27 | 171 | 1.22 | +4 | ◎ | This |
| | G | 153 | 1.27 | 209 | 1.32 | 181 | 1.27 | +4 | ◎ | invention |
| | R | 139 | 1.42 | 183 | 1.47 | 159 | 1.42 | +5 | ◎ | |
| 208 | B | 173 | 1.15 | 238 | 1.24 | 207 | 1.19 | +1 | ○~◎ | This |
| | G | 184 | 1.24 | 251 | 1.29 | 220 | 1.25 | +1 | ○~◎ | invention |
| | R | 162 | 1.37 | 220 | 1.44 | 194 | 1.39 | +2 | ○~◎ | |
| 209 | B | 37 | 0.84 | 63 | 0.91 | 37 | 0.46 | +27 | ◎ | Comparative |
| | G | 42 | 0.87 | 67 | 0.91 | 42 | 0.47 | +28 | ◎ | example |
| | R | 35 | 0.96 | 53 | 0.99 | 32 | 0.52 | +33 | ◎ | |
| 210 | B | 58 | 0.85 | 88 | 0.92 | 63 | 0.76 | +13 | x | Comparative |
| | G | 60 | 0.89 | 92 | 0.93 | 68 | 0.78 | +15 | x | example |
| | R | 49 | 1.01 | 74 | 1.04 | 54 | 0.87 | +18 | x | |
| 211 | B | 59 | 1.03 | 91 | 1.11 | 70 | 1.00 | +9 | x | Comparative |
| | G | 62 | 1.08 | 94 | 1.13 | 73 | 1.03 | +11 | x | example |
| | R | 64 | 1.25 | 97 | 1.29 | 74 | 1.18 | +13 | x | |
| 212 | B | 123 | 1.24 | 159 | 1.28 | 138 | 1.23 | +4 | ◎ | This |
| | G | 125 | 1.26 | 161 | 1.30 | 140 | 1.25 | +5 | ◎ | invention |
| | R | 139 | 1.43 | 178 | 1.46 | 154 | 1.41 | +5 | ◎ | |

Note
S[1]: sensitivity
C[2]: contrast

As is apparent from the results, the effect of the present invention is remarkable also in the multilayer color photographic materials. That is, in Sample 201, prepared by using an emulsion having a silver bromide content of 40 mol %, although the fluctuation of the sensitivity due to a change of temperature at the time of exposure is less, the developing speed is slow, so that it is not suitable for practice. In the case of Sample 202, wherein the silver chloride content is increased to 80 mol %, the developing speed is inadequate.

In contrast, in the case of the sample that uses a silver halide emulsion having a silver chloride content of 98% or 100%, the developing speed is increased greatly, to allow rapid processing, but as in Sample 203 or 209, wherein only the silver chloride content is increased, the sensitivity is low, and further the sensitivity and contrast decrease greatly at high illuminance, and the fluctuation of the sensitivity due to a change of temperature at the time of exposure is great, so that it cannot be put into practice.

Although by the introduction of iron ions the reciprocity law failure and the fluctuation of sensitivity due to a change of temperature at the time of exposure can be lessened, pressure results in desensitization, which is not preferable.

Only upon the use of emulsions wherein iron ions are concentrated in the grain surface layer as in the present invention, multilayer color photographic materials can be provided that are excellent in rapid processability, high in sensitivity and contrast, less in the fluctuation of sensitivity due to a change of temperature at the time of exposure, and excellent in pressure resistance.

Having described our invention as related to the embodiment, it is our intention that the invention be not limited by any of the details of the description, unless otherwise specified, but rather be construed broadly within its spirit and scope as set out in the accompanying claims.

What we claim is:

1. A silver halide photographic material comprising a base and on said base at least one photosensitive emulsion layer containing silver halide emulsion of a surface latent image type that contains silver halide grains of silver chloride or silver chlorobromide made up of 90 mol % or more of silver chloride substantially free from silver chloride, said silver halide grains containing iron ions in an amount of $10^{-7}$ to $10^{-3}$ mol per mol of the silver halide wherein said silver halide grains comprise a core and a surface layer that amounts to 50% or less of the grain volume and the iron ions are supplied together with a supply of an aqueous silver salt solution and an aqueous halide solution for forming the surface layer so that the concentration of iron ions in the surface layer is then times or more the concentration of iron ions in the core.

2. The silver halide photographic material as claimed in claim 1, wherein the silver chloride content in the silver halide grains is 95 mol % or more.

3. The silver halide photographic material as claimed in claim 1, wherein the silver iodide content in the silver halide grains is 0.5 mol % or less.

4. The silver halide photographic material as claimed in claim 1, wherein silver bromide is present in the form of silver bromide localized phases having silver bromide content of 10 to 70 mol % within or on the surface of silver halide grains.

5. The silver halide photographic material as claimed in claim 1, wherein iron ions are incorporated into the silver halide emulsion grains by adding an iron compound in the step of forming the silver halide grains.

6. The silver halide photographic material as claimed in claim 5, wherein the iron compound is water-soluble.

7. The silver halide photographic material as claimed in claim 5, wherein the iron compound is selected from the group consisting of ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ferrous ammonium nitrate, basic ferric acetate, ferric albuminate, ferric ammonium acetate, ferric bromide, ferric chloride, ferric chromate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidium ferric sulfate, ammonium ferric citrate, potassium hexacyanoferrate(II), potassium pentacyanoammineferrate(II), sodium iron(III) ethylenedinitrilotetraacetic acetate, potassium hexacyanoferrate(III), iron(III) tris(pipyridyl) chloride, and potassium pentacyanonitrosylferrate(III).

8. The silver halide photographic material as claimed in claim 5, wherein the iron compound is selected from the group consisting of hexacyanoferrates(II), hexacyanoferrates(III), ferrous thiocyanate, and ferric thiocyanate.

9. The silver halide photographic material as claimed in claim 1, wherein the iron ions content in the silver halide grains is $1\times10^{-6}$ to $1\times10^{-4}$ mol per mol of silver halide.

10. The silver halide photographic material as claimed in claim 1, wherein the surface layer of the silver halide grain amounts to 40% or less of the grain volume.

11. The silver halide photographic material as claimed in claim 1, wherein the concentration of iron ions in the surface layer is 50 times or more the concentration of iron ions in the core.

* * * * *

UNITED STATES PATENT AND TRADEMARK OFFICE

CERTIFICATE OF CORRECTION

PATENT NO. : 5,204,234

DATED : April 20, 1993

INVENTOR(S) : Asami

It is certified that error appears in the above-identified patent and that said Letters Patent is hereby corrected as shown below:

Column 60, line 59, delete "chloride" and insert therefor --iodide--.

Signed and Sealed this

Third Day of May, 1994

Bruce Lehman

*Attest:*

BRUCE LEHMAN

*Attesting Officer*

*Commissioner of Patents and Trademarks*